US008185022B2

(12) United States Patent
Sato

(10) Patent No.: US 8,185,022 B2
(45) Date of Patent: May 22, 2012

(54) IMAGE FORMING APPARATUS AND PROCESS CARTRIDGE

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 510 days.

(21) Appl. No.: 12/388,016

(22) Filed: Feb. 18, 2009

(65) Prior Publication Data

US 2009/0208245 A1 Aug. 20, 2009

(30) Foreign Application Priority Data

Feb. 18, 2008 (JP) ..... 2008-036178

(51) Int. Cl.
*G03G 15/08* (2006.01)
*G03G 21/16* (2006.01)

(52) U.S. Cl. ..... 399/258; 399/102; 399/111

(58) Field of Classification Search ..... 399/98, 399/102, 103, 106, 111, 113, 119, 258, 262
See application file for complete search history.

(56) References Cited

U.S. PATENT DOCUMENTS

| | | | | |
|---|---|---|---|---|
| 6,041,203 | A | 3/2000 | Suzuki et al. | |
| 6,330,410 | B1 | 12/2001 | Okabe et al. | |
| 6,418,292 | B1 * | 7/2002 | Isobe et al. | 399/258 |
| 6,546,216 | B2 * | 4/2003 | Mizoguchi et al. | 399/106 |
| 7,031,637 | B2 | 4/2006 | Fujita | |
| 7,657,206 | B2 | 2/2010 | Sato | |
| 2008/0025758 | A1 | 1/2008 | Sato | |

FOREIGN PATENT DOCUMENTS

| | | | |
|---|---|---|---|
| JP | 61-022367 | A | 1/1986 |
| JP | 4-084156 | A | 3/1992 |
| JP | 6-175494 | A | 6/1994 |
| JP | 2000-250378 | | 9/2000 |
| JP | 2003-084556 | | 3/2003 |
| JP | 2003-295562 | | 10/2003 |
| JP | 2005-284178 | | 10/2005 |
| JP | 2008-026828 | A | 2/2008 |

OTHER PUBLICATIONS

JP Decision of Grant mailed Jan. 5, 2012, JP Appln. 2008-036178, partial English Translation.

* cited by examiner

*Primary Examiner* — Sandra Brase
(74) *Attorney, Agent, or Firm* — Banner & Witcoff, Ltd.

(57) ABSTRACT

An image forming apparatus is provided including a casing, a process cartridge, and a toner box. The process cartridge includes: a first housing which supports an electrostatic latent image carrier and which has a first opening and a first edge portion; and a second housing which supports a toner carrier, which is attached to the first housing so that the toner carrier confronts the electrostatic latent image carrier and the second housing is movable relative to the first housing and which has a second opening and a second edge portion. The process cartridge further includes an elastic element which blocks a gap between the first edge portion and the second edge portion and which permits relative movement between the first opening and the second opening, while allowing toner communication between the first opening and the second opening.

21 Claims, 16 Drawing Sheets

LEFT ← → RIGHT 72
72C
97
98 (98A)
93 (93A)
93A
108
80
71A
71
70

IMAGE FORMING APPARATUS AND PROCESS CARTRIDGE

CROSS REFERENCE TO RELATED APPLICATION

The present disclosure relates to the subject matter contained in Japanese patent application No. 2008-036178 filed on Feb. 18, 2008, which is expressly incorporated herein by reference in its entirety.

TECHNICAL FIELD

The present invention relates to an electrophotographic image forming apparatus and a process cartridge to be installed in the image forming apparatus.

BACKGROUND ART

For example, Patent Document 1 discloses a laser printer as an electrophotographic image forming apparatus. The laser printer includes a housing and a process unit detachably disposed within the housing. The process unit includes a photosensitive member cartridge and a developing cartridge. The photosensitive member cartridge includes a photosensitive drum on a surface of which an electrostatic latent image is to be formed. A toner accommodation chamber is provided in the developing cartridge, and the developing cartridge includes a developing roller for supplying toner from the toner accommodation chamber to the photosensitive drum to visualize the electrostatic latent image on the photosensitive drum.

The developing cartridge is detachably attached to the photosensitive member cartridge. The photosensitive member cartridge includes a biasing unit for biasing the developing cartridge.

In a case where the developing cartridge is attached to the photosensitive member cartridge outside the housing, the biasing unit does not bias the developing cartridge, and therefore the developing roller of the developing cartridge is not pressed against the photosensitive drum of the photosensitive member cartridge although the developing roller may approach the photosensitive roller. When the photosensitive member cartridge having the developing cartridge attached thereto is installed in the housing as the process unit, the biasing unit of the photosensitive member cartridge biases the developing cartridge to press the developing roller against the photosensitive drum.

The presence of the biasing unit provides the following advantage: The developing cartridge is movable relative to the photosensitive member cartridge in a state in which the developing cartridge is attached to the photosensitive member cartridge, and hence, the developing roller is movable relative to the photosensitive drum to follow the movement of the developing cartridge relative to the photosensitive member cartridge. Accordingly, the developing roller can be appropriately moved depending on a surface condition of the photosensitive drum so as to follow the photosensitive drum and supply toner to the photosensitive drum in a smooth fashion. Compared with a case where a relative movement of the developing roller to the photosensitive drum is inhibited, the printer of this type can achieve a highly accurate visualization of an electrostatic latent image.

Patent Document 1: JP-A-2000-250378

For the printer of this type, it is conceivable to adopt an arrangement in which the toner accommodation chamber is separable from the developing cartridge. Since only the toner accommodation chamber, to which maintenance service is given highly frequently, can be replaced as a toner box, the utility of the printer can be increased.

However, because the developing cartridge is movable within the housing of the printer, the toner box separable from the developing cartridge has to be arranged movable within the housing to follow the movement of the developing cartridge in order to avoid toner leakage between the toner box and the developing cartridge. This makes the structure of the printer complicated. Further, because the toner box is substantially integral with the developing cartridge (and thus the process unit), it is difficult to attach and detach only the developing cartridge (process unit) to and from the housing separately from the toner box.

SUMMARY

As an illustrative, non-limiting embodiment, the present invention can provide an image forming apparatus including a casing, a process cartridge detachably attached to the casing, and a toner box attached to the casing. At least one of the casing and the toner box has a passage opening through which toner is movable between the toner box and the process cartridge. The process cartridge includes: a first housing which rotatably supports an electrostatic latent image carrier and which has a first opening and a first edge portion bounding the first opening; and a second housing which supports a toner carrier, which is attached to the first housing so that the toner carrier confronts the electrostatic latent image carrier and the second housing is movable relative to the first housing in an orthogonal direction substantially orthogonal to a rotational axis of the electrostatic latent image carrier and which has a second opening and a second edge portion bounding the second opening. The process cartridge is attached to the casing so that the first opening confronts and communicates with the passage opening and a relative position of the first opening to the passage opening is fixed. The process cartridge further includes an elastic element which blocks a gap between the first edge portion and the second edge portion and which permits relative movement between the first opening and the second opening, while ensuring toner communication between the first opening and the second opening.

As another illustrative, non-limiting embodiment, the present invention can provide a process cartridge that is detachably attachable to an image forming apparatus. The process cartridge includes: a first housing which rotatably supports an electrostatic latent image carrier and which has a first opening and a first edge portion bounding the first opening; a second housing which supports a toner carrier, which is attached to the first housing so that the toner carrier confronts the electrostatic latent image carrier and the second housing is movable relative to the first housing in an orthogonal direction substantially orthogonal to a rotational axis of the electrostatic latent image carrier and which has a second opening and a second edge portion bounding the second opening; and an elastic element which blocks a gap between the first edge portion and the second edge portion and which permits relative movement between the first opening and the second opening, while ensuring toner communication between the first opening and the second opening.

As one of advantages, the present invention can provide an image forming apparatus including a process cartridge having a toner carrier and an electrostatic latent image carrier that are relatively movable. As another one of the advantages, the present invention can provide an image forming apparatus including a process cartridge and a toner box accommodating therein toner to be supplied to the process cartridge and being separable from the process cartridge. As yet another one of the advantages, the present invention can provide an image forming apparatus including a process cartridge and a toner box, in which the process cartridge is attachable to and detachable from the image forming apparatus main body separately from the toner box. As still another one of the advantages, the present invention can provide a process cartridge to be installed in the image forming apparatus. These and other advantages of the present invention will be discussed in detail with reference to the accompanying drawings.

DESCRIPTION OF THE PREFERRED EMBODIMENT

1. Overall Configuration of Color Printer

Figure 1:
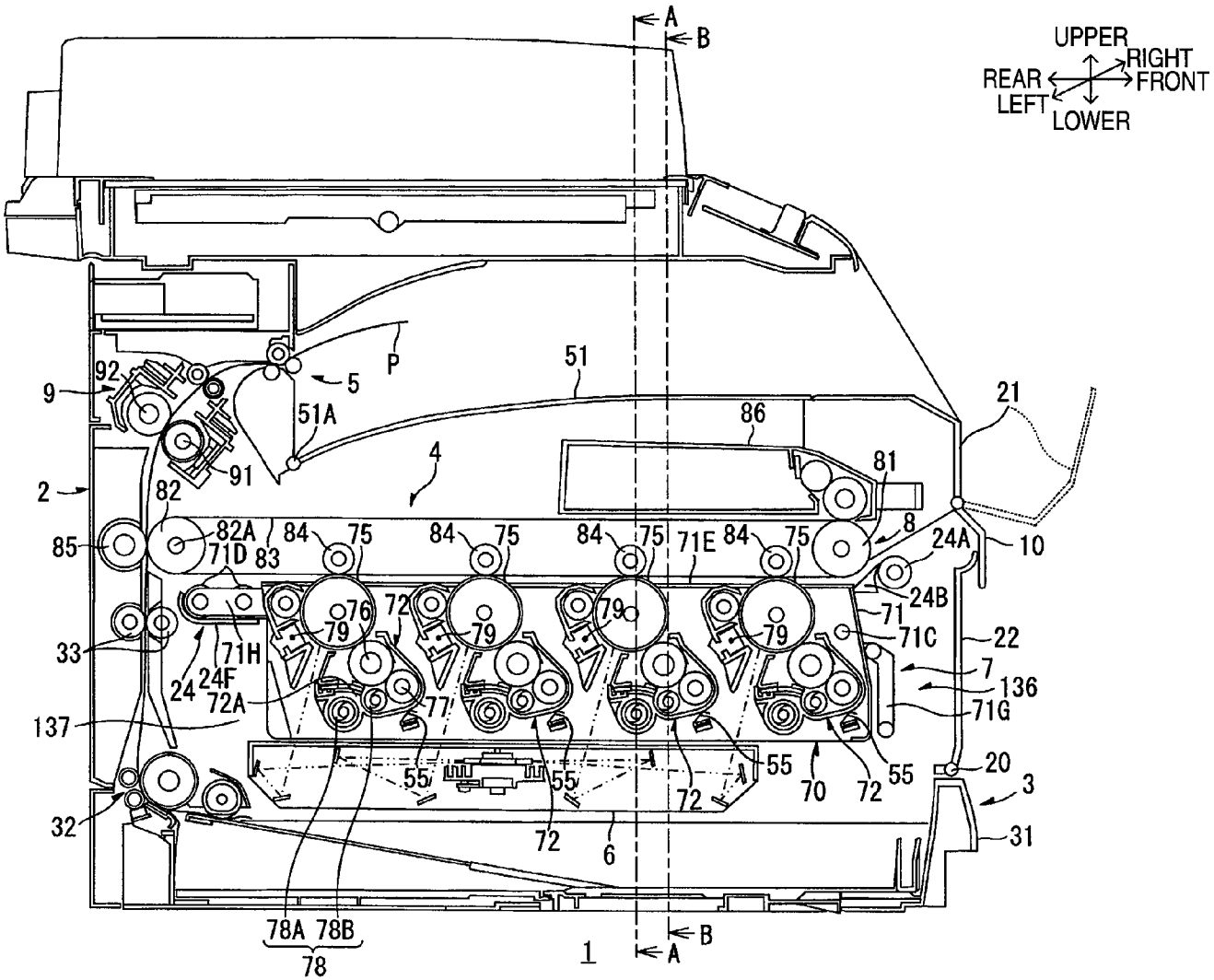
FIG. 1 is a left side sectional view of a color printer which constitutes an example of an image forming apparatus according to an embodiment of the invention.
Figure 2:
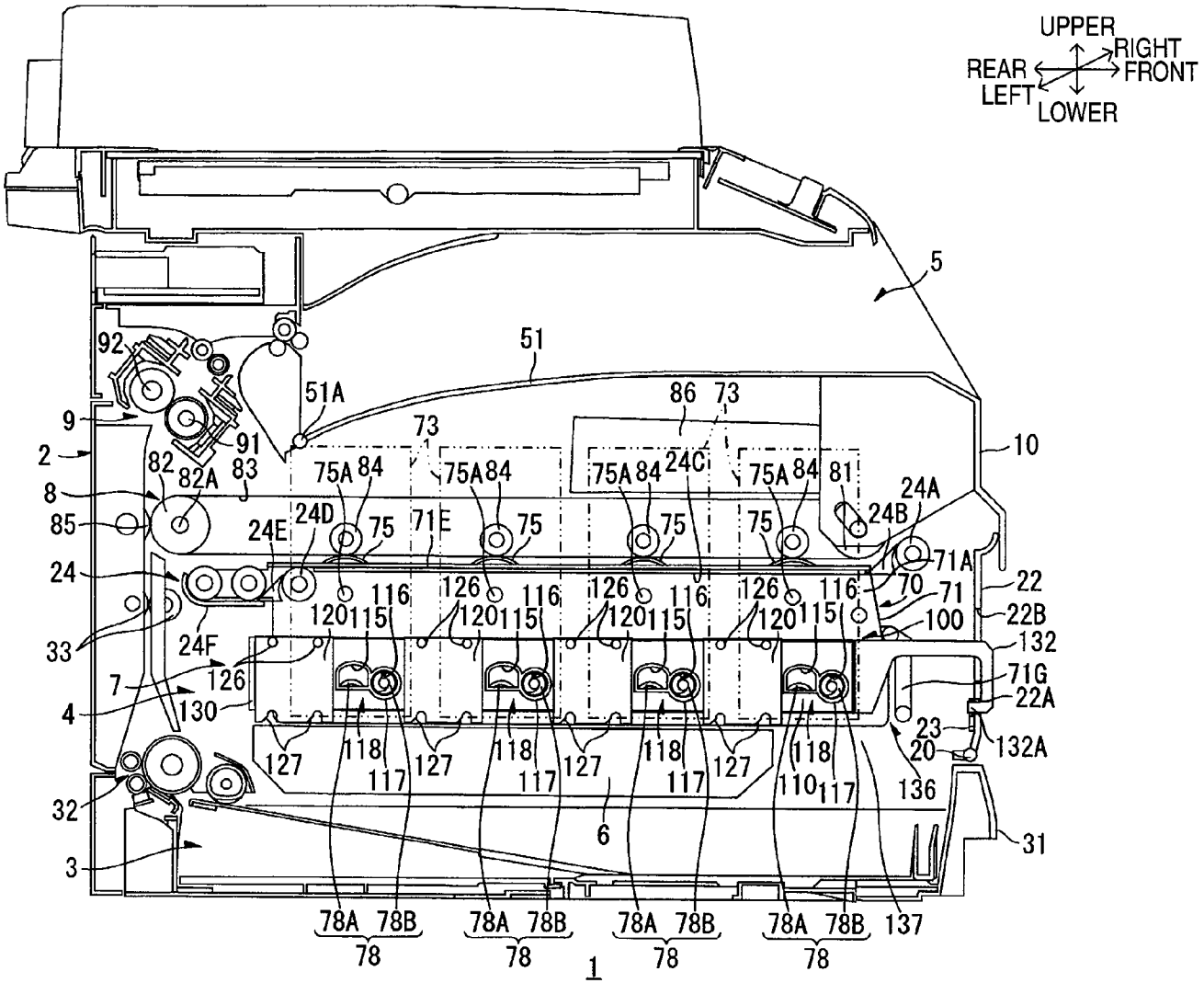
FIG. 2 is a left side sectional view of the color printer in a position where a left side face of a process cartridge is visible.

FIG. 1 is a left side sectional view of a color printer which constitutes an example of an image forming apparatus according to an embodiment of the invention. FIG. 2 is a left side sectional view of the color printer in a position where a left-hand side face of a process cartridge is visible.

As shown in FIG. 1, a color printer 1 includes a box-shaped casing 2 as an example of an apparatus casing. The color printer 1 further includes a sheet feeding part 3 for feeding sheets P, an image forming part 4 for forming an image on a sheet P fed from the sheet feeding part 3 and a sheet discharging part 5 for discharging the sheet P on which the image has been formed to a location outside the color printer 1.

For ease of explanation, the description will be made with reference to directions indicated by arrows indicated in the accompanying drawings unless otherwise mentioned. The directions denoted herein are specified based on directions as viewed by a person who is standing at a front side of the color printer 1. Note that in FIG. 1, the left-hand side of the color printer 1 is a near side of a sheet of paper on which FIG. 1 is drawn, while the right-hand side thereof is a far side of the sheet of paper. A right-left or transverse direction corresponds to a width direction. Those directions are intended to facilitate the understanding of the structure of the printer 1, and should not be interpreted in a restrictive sense.

Sheet Feeding Part

The sheet feeding part 3 includes: a sheet feeding tray 31 which is detachably installed in the casing 2 at a lower portion thereof, a sheet feeding mechanism 32 for feeding sheets P from the sheet feeding tray 31 to the image forming part 4; and registration rollers 33. The sheet feeding mechanism 32 includes a sheet feeding roller, a sheet separation roller, a sheet separation pad and a paper dust collecting roller (given no reference numerals), and is configured to separate and feed sheets P stacked within the sheet feeding tray 31 to the upper registration rollers 33 sheet by sheet. The registration rollers 33 align a leading end of a sheet P (eliminate a skew of the sheet P fed to the registration rollers 33) and then feed the sheet P to the image forming part 4 (a secondary transfer position, which will be described later).

(2) Image Forming Part

The image forming part 4 includes a scanner part 6, a process part 7, a transfer part 8 and a fixing part 9.

(2-1) Scanner Part

The scanner part 6 is disposed at a lower portion in the casing 2. Specifically, the scanner part 6 is disposed adjacent to an upper side of the feeding tray 31, and includes a laser beam emitting unit, a polygon mirror, and pluralities of lens elements and reflecting mirrors (given no reference numerals). As shown by two-dotted chain lines in FIG. 1, the scanner part 6 functions to emit laser beams corresponding to respective colors of cyan, magenta, yellow and black from the laser beam emitting unit and guide the laser beams to irradiate photosensitive drums 75 (which will be described later) of the process part 7. The photosensitive drum 75 constitutes an example of an electrostatic latent image carrier.

(2-2) Process Part

The process part 7 is disposed adjacent to an upper side of the scanner part 6. The process part 7 includes a process cartridge 70 and four toner boxes 73 (refer to FIG. 2) which are disposed to confront an outer side (left-hand side) of the process cartridge 70.

The process cartridge 70 is detachably installed in the casing 2. The process cartridge 70 can be attached to and detached from the casing 2 in a front-rear or longitudinal direction.

The process cartridge 70 includes; a first housing 71 having a hollow box shape; and four second housings 72 in an interior of the first housing 71.

Four photosensitive drums 75 and four chargers 79 are mainly disposed at an upper portion in the first housing 71.

The four photosensitive drums 75 are disposed in parallel in the longitudinal direction at substantially equal intervals. Each photosensitive drum 75 is disposed such that its rotational shaft extends along the width direction (that is, its rotational axis direction coincides with the width direction), and is supported by left and right side walls (a left-hand side wall 71A as an example of a first wall and a right-hand side wall 71B, refer to FIG. 3(*c*)) of the first housing 71 to be held therebetween. Accordingly, the photosensitive drums 75 are supported rotatably by the first housing 71. Upper outer circumferential surfaces of the photosensitive drums 75 are exposed from an upper surface of the first housing 71.

Similarly to the photosensitive drums 75, the chargers 79 are supported by the left- and right-hand side walls of the first housing 71 to be held therebetween. Each of the chargers 79 is disposed at an obliquely rear side of the respective photosensitive drum 75 to confront the respective photosensitive drums 75 while being spaced apart therefrom.

The four second housings 72 are disposed in parallel along the longitudinal direction in the interior of the first housing 71. Each second housing 72 is disposed adjacent to a lower side of the corresponding photosensitive drum 75. As will be described later, the four second housings 72 are attached to the first housing 71 such that the second housings 72 are movable relative to the first housing 71. Further, when the process cartridge 70 is attached to or detached from the casing 2, the four second housings 72 are attached to or detached from the casing 2 together with the first housing 71.

The second housing 72 has a hollow box shape which is elongated in the width direction. Disposed mainly within the second housing 72 are a developing roller 76 as an example of a toner carrier, a supply roller 77, and a pair of conveying augers 78 as an example of a toner conveying member. Hereinafter, while the second housing 72 disposed at a rearmost position in FIG. 1 will be described mainly, the configuration and arrangement of the developing roller 76, the supply roller 77 and the pair of conveying augers 78 are the same in the remaining three second housings 72.

Rotational axes of the developing roller 76, the supply roller 77 and the pair of conveying augers 78 extend in the width direction. Axial end portions of the developing roller 76, the supply roller 77 and the pair of conveying augers 78 are supported by at least one of left- and right-hand side walls of the second housing 72. That is, the developing roller 76, the supply roller 77 and the pair of conveying augers 78 are rotatably supported by the second housing 72.

The developing roller 76 is disposed at an upper end portion of the second housing 72 so that the upper outer circumferential surface of the developing roller 76 is exposed from the upper surface of the second housing 72. The exposed upper outer circumferential surface of the developing roller 76 confronts (more specifically, contacts) a lower outer circumferential surface of the photosensitive drum 75. The supply roller 77 is disposed obliquely forwards and downwards of the developing roller 76 and is in contact with the developing roller 76. Of the pair of conveying augers 78, one conveying auger 78 (referred to as a first auger 78A) is disposed at a lower end portion of the second housing 72, while the other auger 78 (referred to as a second auger 78B) is disposed between the first auger 78A and the supply roller 77. A partition wall 72A is provided in the second housing 72 between the first auger 78A and the second auger 78B. The partition wall 72A partially separates the first auger 78A from the second auger 78B in such a manner that a right end portion of the first auger 78A communicates with a right end portion of the second auger 78B (not shown).

As shown by two dotted chain lines in FIG. 2, the four toner boxes 73 are disposed at a left-hand side of the process cartridge 70 and in parallel along the longitudinal direction. These toner boxes 73 are detachably installed in the casing 2. More specifically, the toner boxes 73 and the process cartridge 70 are detachably installed in the casing 2 independently (individually) from each other.

The toner box 73 has, for example, a vertically elongated hollow box shape, and accommodates in an interior thereof toner of a corresponding one of four colors of cyan, magenta, yellow and black. Each toner box 73 is disposed to confront the left-hand side of the corresponding second housing 72 (refer to FIG. 1).

The process part 7 described above functions as follows: The outer circumferential surface of the photosensitive drum 75 is positively charged uniformly by the chargers 79 shown in FIG. 1. The laser beam from the scanner part 6 (refer to the two-dotted chain line in FIG. 1) is irradiated onto the positively charged outer circumferential surface of the photosensitive drum 75 to form an electrostatic latent image (corresponding to an image of one color to be formed on a sheet P) on the outer circumferential surface of the photosensitive drum 75. This way, the electrostatic latent image is carried on the photosensitive drum 75.

Toner in the toner box 73 (refer to FIG. 2) is supplied to the process cartridge 70, specifically, to a left end portion of the first auger 78A of the second housing 72 (the details of this will be described later). The toner thus supplied is first conveyed to the right by the rotation of the first auger 78A and is then passed over to the right end portion of the second auger 78B at the right end portion of the first auger 78A. Thereafter, the toner thus passed over to the second auger 78B is conveyed to the left by the rotation of the second auger 78B so that the toner is supplied to the supply roller 77. The toner supplied to the supply roller 77 is supplied to the developing roller 76 so that the developing roller 76 carries the toner as a thin layer of a certain thickness on the outer circumferential surface of the developing roller 76.

When the electrostatic latent image on the outer circumferential surface of the photosensitive drum 75 comes to confront the developing roller 76 by the rotation of the photosensitive drum 75, the toner carried on the outer circumferential surface of the developing roller 76 is supplied to the electrostatic latent image. Accordingly, the electrostatic latent image is visualized (developed), that is, a toner image is carried on the outer circumferential surface of the photosensitive drum 75. The toner, which has not been used for developing, continues to be conveyed to the left by the second auger 78B to be returned to the toner box 73 (the details of which will be described later).

(2-3) Transfer Part

The transfer part 8 includes a drive roller 81, a driven roller 82, an intermediate transfer belt 83, primary transfer rollers 84, a secondary transfer roller 85 and a cleaning unit 86.

The drive roller 81 and the driven roller 82 are disposed spaced apart from each other in the longitudinal direction, and the endless intermediate transfer belt 83 is suspended between the rollers 81 and 82. The intermediate transfer belt 83 is disposed adjacent to an upper side of the first housing 71. The driven roller 82 is driven to rotate by the drive roller 81 drives and rotates the intermediate transfer belt 83 and driven roller 82 so that the intermediate transfer belt 83 is cyclically moved between the drive roller 81 and the driven roller 82.

The four primary transfer rollers 84 are disposed at predetermined intervals in the longitudinal direction inside the intermediate transfer belt 83. Each primary transfer roller 84 is disposed to confront the corresponding photosensitive drum 75 across the intermediate transfer belt 83. A contact position between the photosensitive drum 75 and the intermediate transfer belt 83 is referred to as a primary transfer position. A primary transfer bias is applied to the primary transfer roller 84 from a high-voltage substrate, not shown, so that the toner image on the photosensitive drum 75 is transferred onto the intermediate transfer belt 83 at the primary transfer position.

The secondary transfer roller 85 is pressed against the rear side of the driven roller 82 via the intermediate transfer belt 83. A contact position between the driven roller 82 (the intermediate transfer belt 83) and the secondary transfer roller 85 is referred to as a secondary transfer position. A secondary transfer bias is applied to the secondary transfer roller 85 from a high-voltage substrate, not shown, so that a superimposed color toner image on the intermediate transfer belt 83 is transferred at the secondary transfer position onto a sheet P fed upwards from the registration rollers 33.

The cleaning unit 86 is disposed above the intermediate transfer belt 83 for recovering the toner adhering to the intermediate transfer belt 83 and storing the recovered toner in an interior thereof. This cleaning unit 86 can be replaced upon opening a first front cover 21 rotatably supported at a front side of the casing 2.

(2-4) Fixing Part

The fixing part 9 is disposed downstream of the transfer part 8 in the conveying direction of sheets P. Specifically, the fixing part 9 is disposed above the secondary transfer roller 85 and includes a heating roller 91 and a pressing roller 92. The pressing roller 92 is in press contact with the heating roller 91. The toner image transferred to the sheet P is fixed by heat and pressure of the heating roller 91 and the pressing roller 92 while the sheet P is passing therebetween.

(3) Sheet Discharging Part

The sheet discharging part 5 has a plurality of conveyer rollers (which are given no numerals) and conveys the sheet P discharged from the fixing part 9 onto a sheet discharging tray 51 formed at an upper portion of the body casing 2.

2. Process Cartridge (1) First Housing

Figure 3:
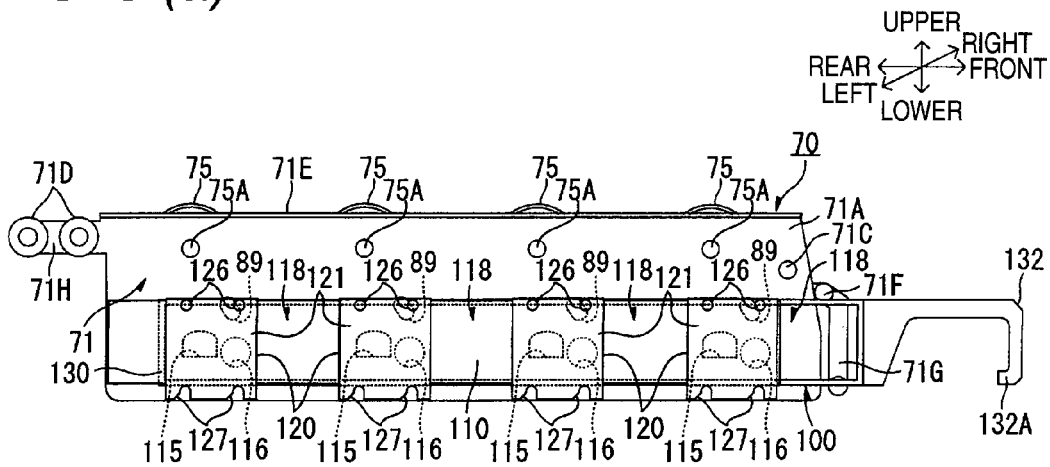
FIG. 3(*a*) is a left side view of the process cartridge in a state in which a first shutter is in a closed position, FIG. 3(*b*) is the left side view of the process cartridge in a state in which the first shutter is in an open position, and FIG. 3(*c*) is a front view of the process cartridge.
Figure 3:
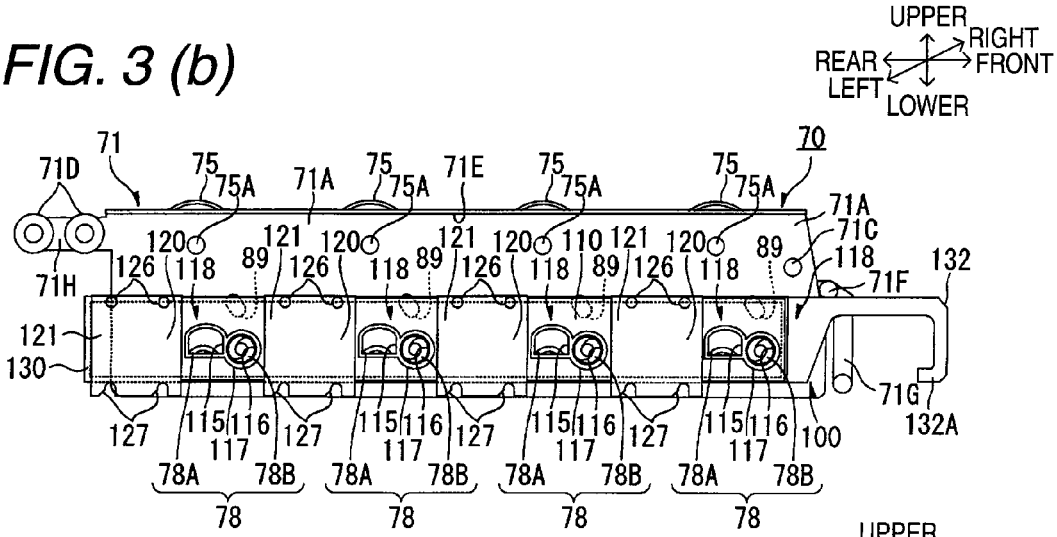
Figure 3:
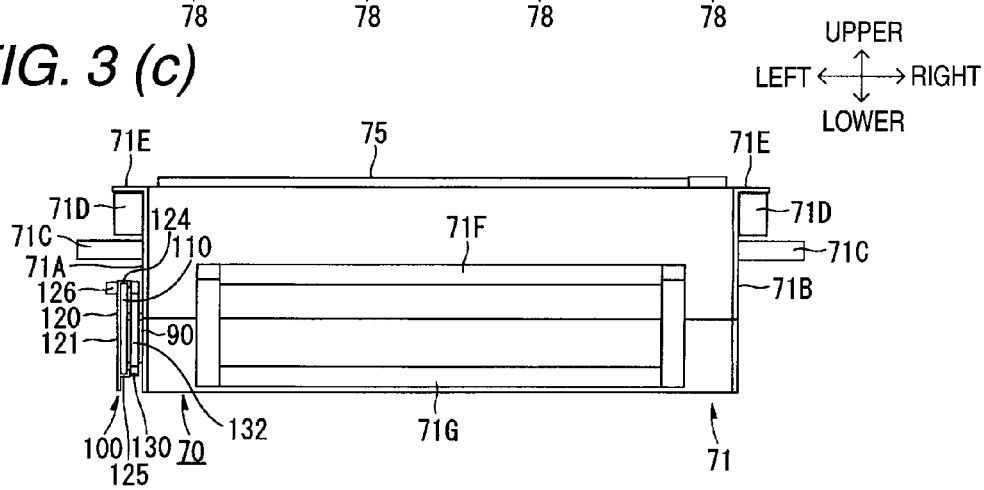
Figure 4:
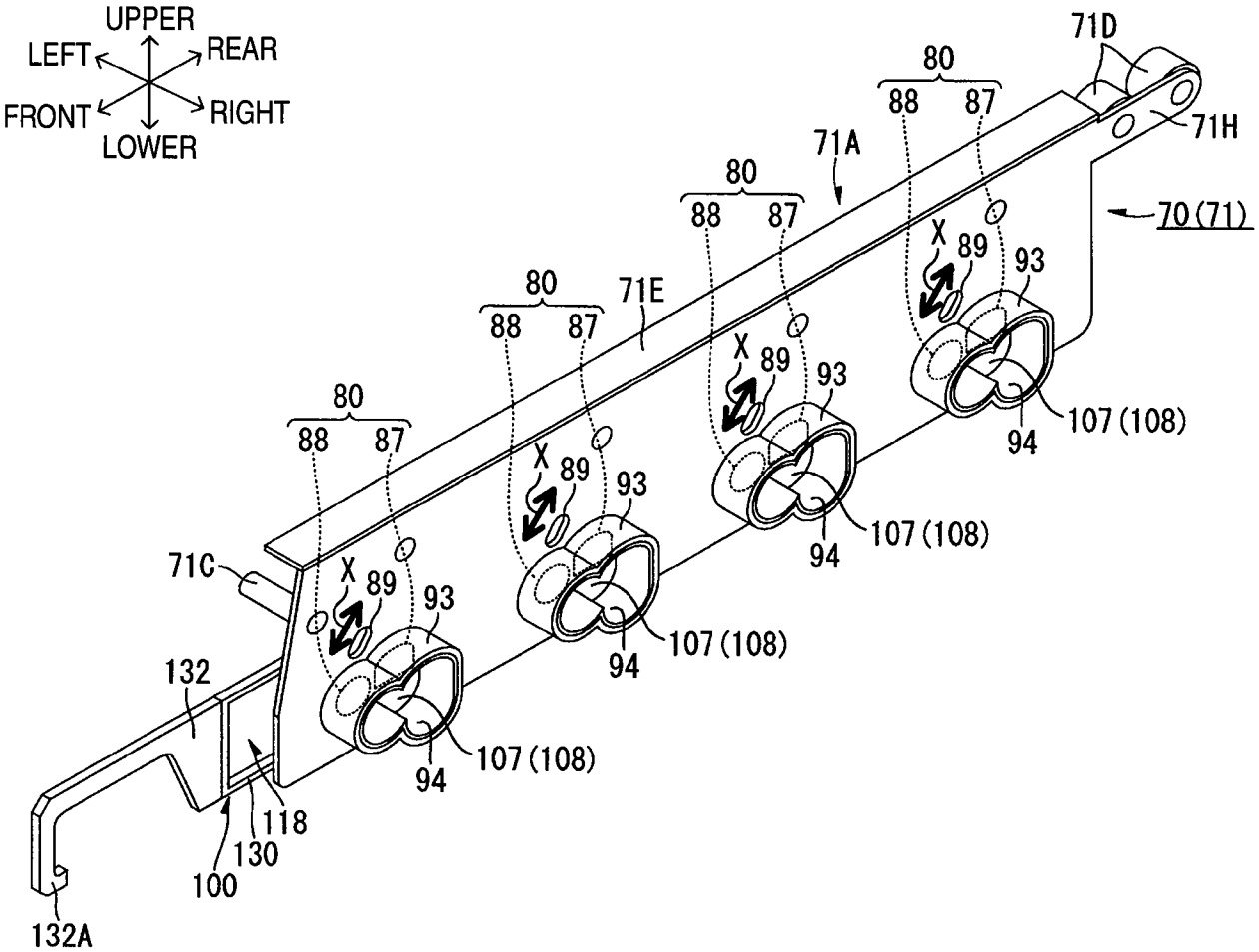
FIG. 4 is a perspective view of a left-hand side wall of the first housing and the first shutter as viewed from a right front side.

FIG. 3 (*a*) shows a left side view of the process cartridge 70 in a state in which a first shutter is in a closed position, FIG. 3(*b*) shows a state in which the first shutter is in an open position, and FIG. 3(*c*) is a front view of the process cartridge 70. FIG. 4 is a perspective view of a left-hand side wall of the first housing and the first shutter as viewed from a right front side.

As has been described before, the first housing 71 holds the four photosensitive drums 75 by the left-hand side wall 71A and the right-hand side wall 71B therebetween (refer to FIG. 3(*c*)). In this state, left end portions of rotational shafts 75A of the photosensitive drums 75 are exposed from the left-hand side wall 71A (refer to FIGS. 3(*a*) and 3(*b*)), while right end portions of the rotational shafts 75A are exposed from the right-hand side wall 71B (not shown). Positioning shafts 71C are provided integrally at front end portions of the left-hand side wall 71A and the right-hand side wall 71B, respectively, to project outwards in the width direction (refer to FIG. 3C)). Upper edge portions of the left-hand side wall 71A and the right-hand side wall 71B are bent outwards in the width direction to constitute flanges 71E (refer to FIG. 3(*c*)).

As shown by dotted lines in FIGS. 3(*a*) and 3(*b*) and also shown in FIG. 4, four insertion holes (through holes) 89 are formed through each of the left-hand side wall 71A and the right-hand side wall 71B (four insertion holes 89 of the left-hand side wall 71A are shown in these drawings). The insertion hole 89 is located at a position obliquely forwards and downwards of the rotational shaft 75A of each photosensitive drum 75. The four insertion holes 89 are formed at predetermined intervals in the longitudinal direction on each of the left-hand side wall 71A and the right-hand side wall 71B. The insertion hole 89 has an oval shape which is elongated obliquely rearwards and upwards and obliquely forwards and downwards. Namely, a longitudinal direction of the insertion hole 89 includes a front-back or longitudinal direction and an up-down or vertical direction, and since these directions are at right angles to the width direction, they are altogether referred to as an orthogonal direction X in the following description (refer to FIG. 4).

As shown in FIG. 4, two through holes, i.e. a first supply hole 87 and a first discharge hole 88, are formed below each insertion hole 89 on the left-hand side wall 71A. The first supply hole 87 has a semicircular shape which is swollen upwards. The fist discharge hole 88 is disposed in front of the first supply hole 87 and is formed as a round hole. The first supply hole 87 and the first discharge hole 88 are collectively referred to as a first opening 80. As will be described later, toner passes through the first opening 80.

Figure 9:
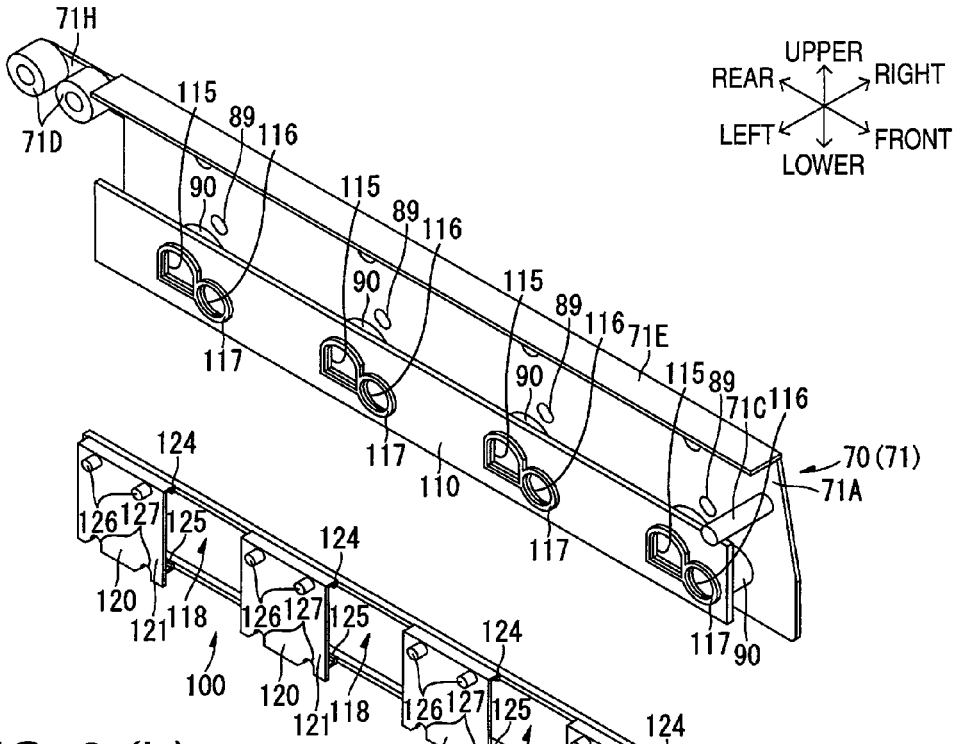
FIG. 9(*a*) is an exploded perspective view of a peripheral portion of the left-hand side wall of the first housing as viewed from a left front side, and FIG. 9(*b*) is a perspective view of the peripheral portion of the left-hand side wall of the first housing as viewed from the left front side.
Figure 9:
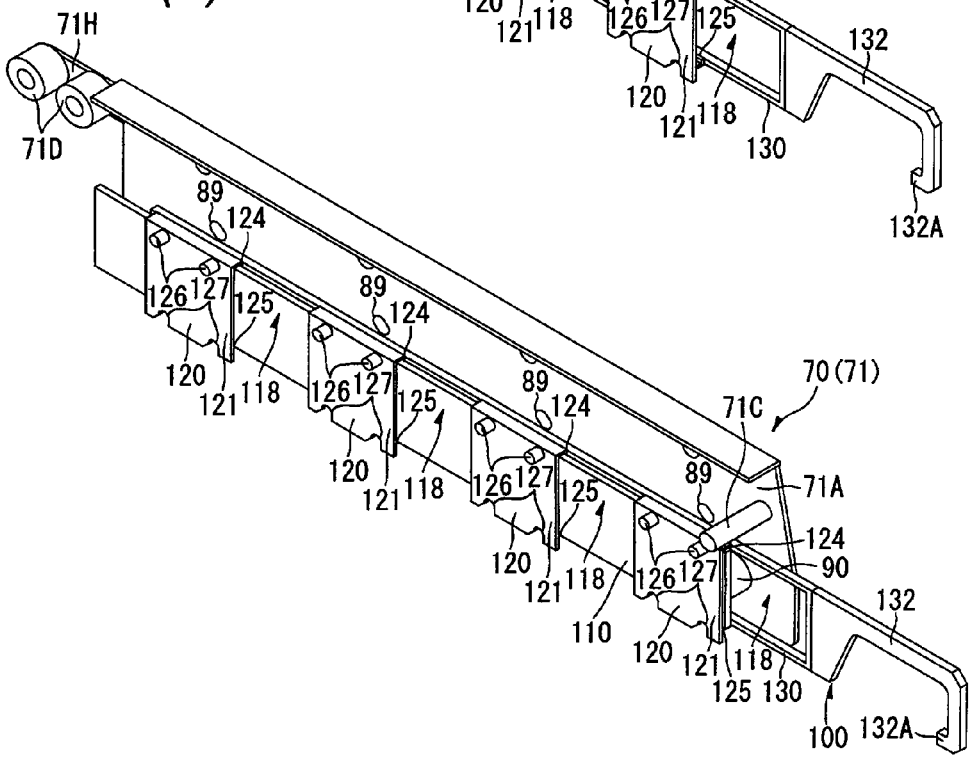

As is shown in FIG. 3(*c*), four outer bosses 90 are provided integrally on an external surface (a left side surface) of the left-hand side wall 71A at predetermined intervals in the longitudinal direction (also, refer to FIG. 9(*a*)). Each outer boss 93 is a hollow element made from a resin and projects leftwards from the left-hand side surface of the left-hand side wall 71A while surrounding both the corresponding first supply hole 87 and first discharge hole 88. The first supply hole 87 and the first discharge hole 88 are separated from each other in an inside of the outer boss 93. That is, the outer boss 93 is configured to function as a surrounding wall surrounding the first supply hole 87 and the first discharge hole 88 and also function as a partition wall partitioning the first supply hole 87 and the first discharge hole 88 one from another.

As shown in FIG. 4, four first bosses 93 as an example of first edge portions are provided integrally on a right side surface of the left-hand side wall 71A at predetermined intervals in the longitudinal direction. Each first boss 93 is a hollow element made from a resin and having a substantially 8-shape as viewed from the right side thereof and projects rightwards from the right side surface of the left-hand side wall 71A while surrounding both the corresponding first supply hole 87 and discharge hole 88. The first supply hole 87 and the first discharge hole 88 are not separated from each other in an inside of the first boss 93. In this way, each first boss 93 bounds the corresponding first supply hole 87 and discharge hole 88 (the first opening 80) on the first housing (specifically speaking, the left-hand side wall 71A). A first elastic element 94 which is formed of a sponge material or the like is bonded to substantially a whole area of an inner circumferential surface of the first boss 93. This sponge is made from a porous material having independent cells. The sponge is preferably made of a urethane or silicone rubber foam and may be made of a soft rubber (this is applied to other sponges).

Referring to FIG. 3(*b*), a projecting piece 71H which projects rearwards is provided integrally at an upper end of a rear end portion of each of the left-hand side wall 71A and the right-hand side wall 71B. Two wheels 71D are provided on an external surface of each projecting piece 71H in the width direction in such a manner as to be aligned longitudinally. Two wheels 71D on the projecting piece 71H of the left-hand side wall 71A and two wheels 71D on the projecting piece 71H of the right-hand side wall 71B are shown in FIG. 3(*c*). Rotational shafts of the wheels 71D extend in the width direction so as to connect to the projecting piece 71H, and in this state, the wheels 71D are supported rotatably by the projecting piece 71H.

A rotational shaft 71F and a lever 71G are provided on a front wall of the first housing 71. The rotational shaft 71F extends in the width direction and is supported on the front wall of the first housing 71. As shown in FIG. 3(*c*), the lever 71G has a substantially U-shape having two fitting end portions and the rotational shaft 71F is inserted into the fitting end portions of the lever 71G. Accordingly, the lever 7G is allowed to rotate freely around the rotational shaft 71F. The lever 71G is gripped when the process cartridge 70 is attached to or detached from the casing 2.

(2) Second Housings

Figure 5:
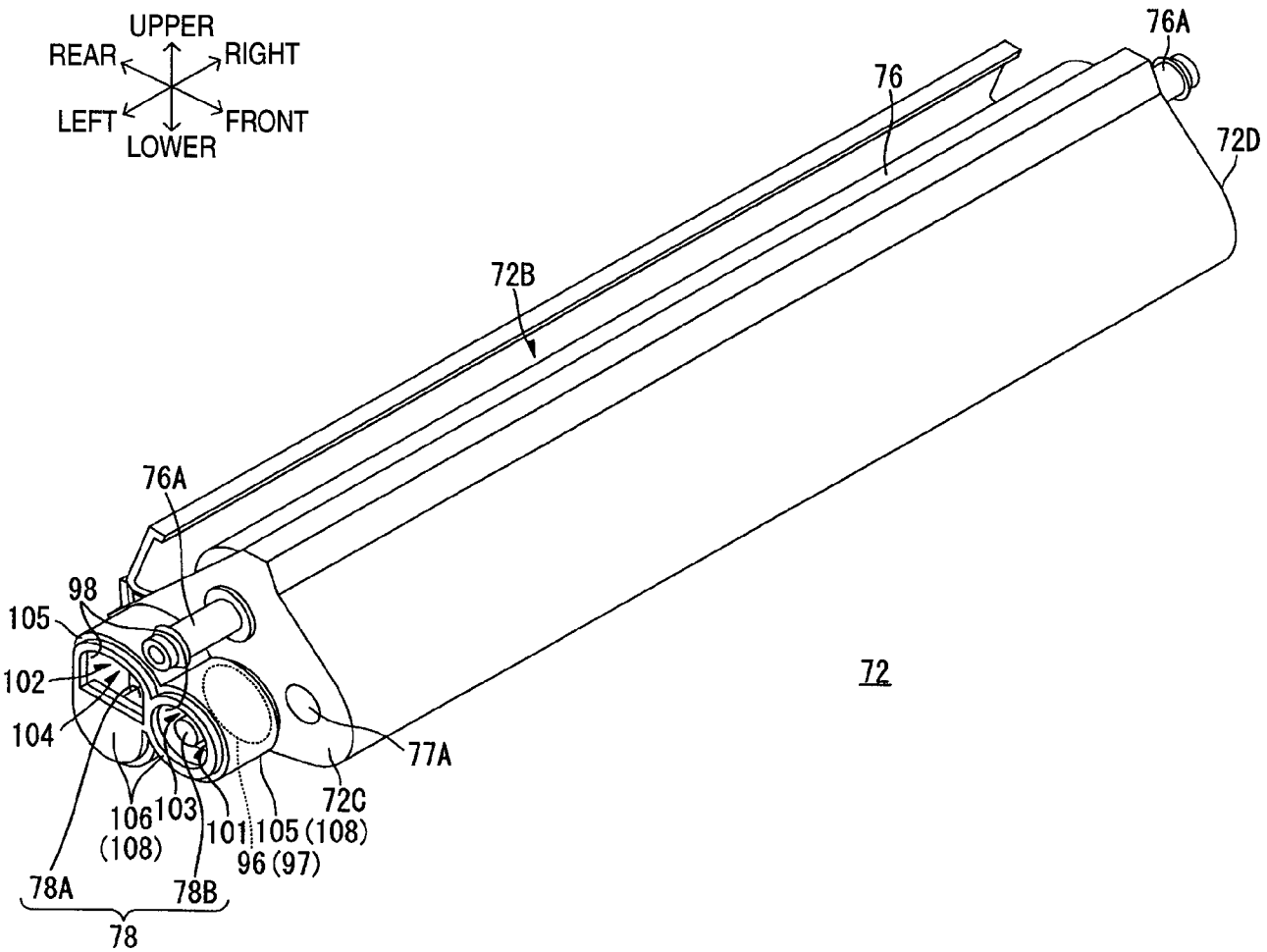
FIG. 5 is a perspective view of a second housing as viewed from a left front side.
Figure 6:
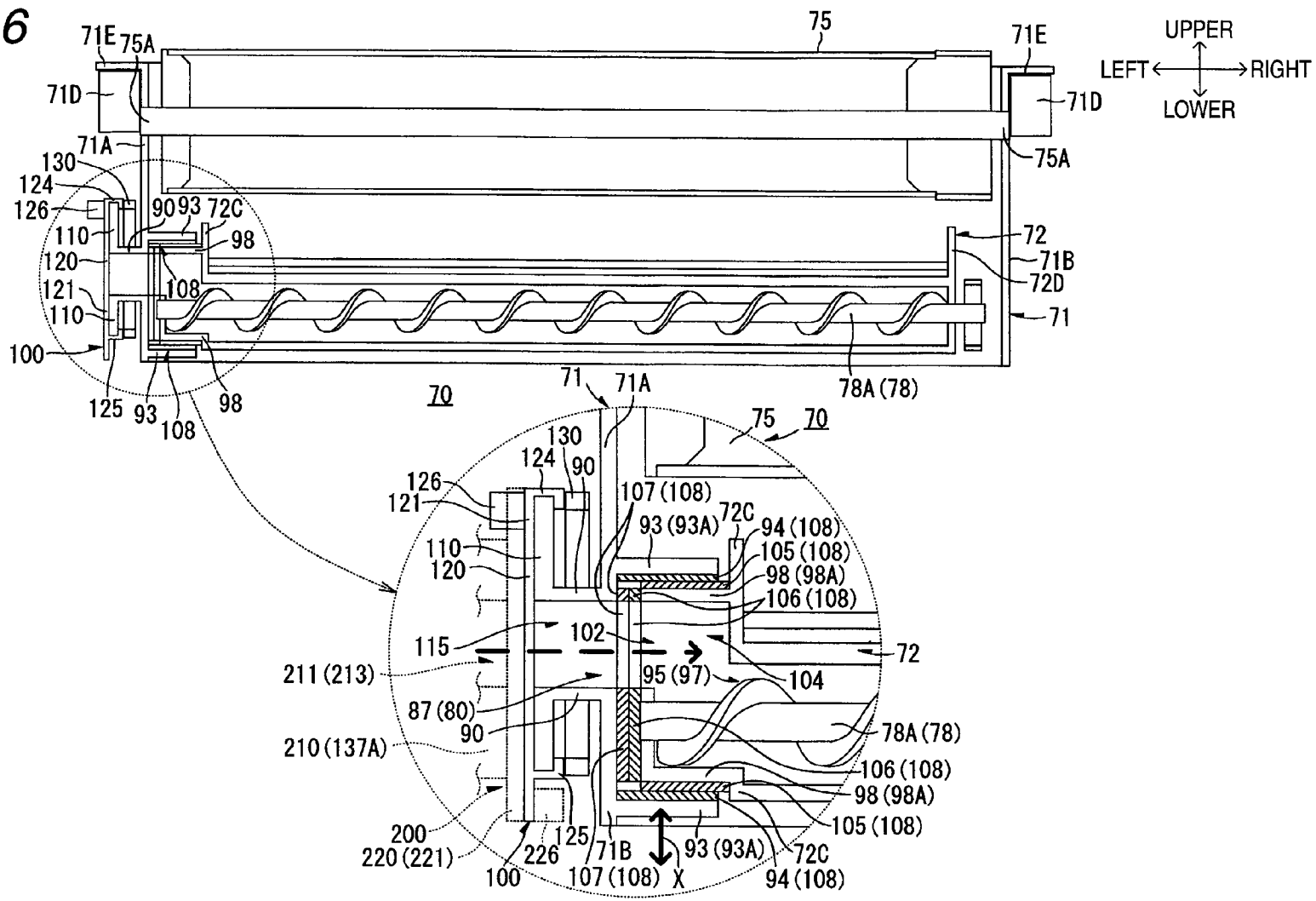
FIG. 6 is a sectional view taken along the line A-A of FIG. 1, showing a portion corresponding to the process cartridge.
Figure 7:
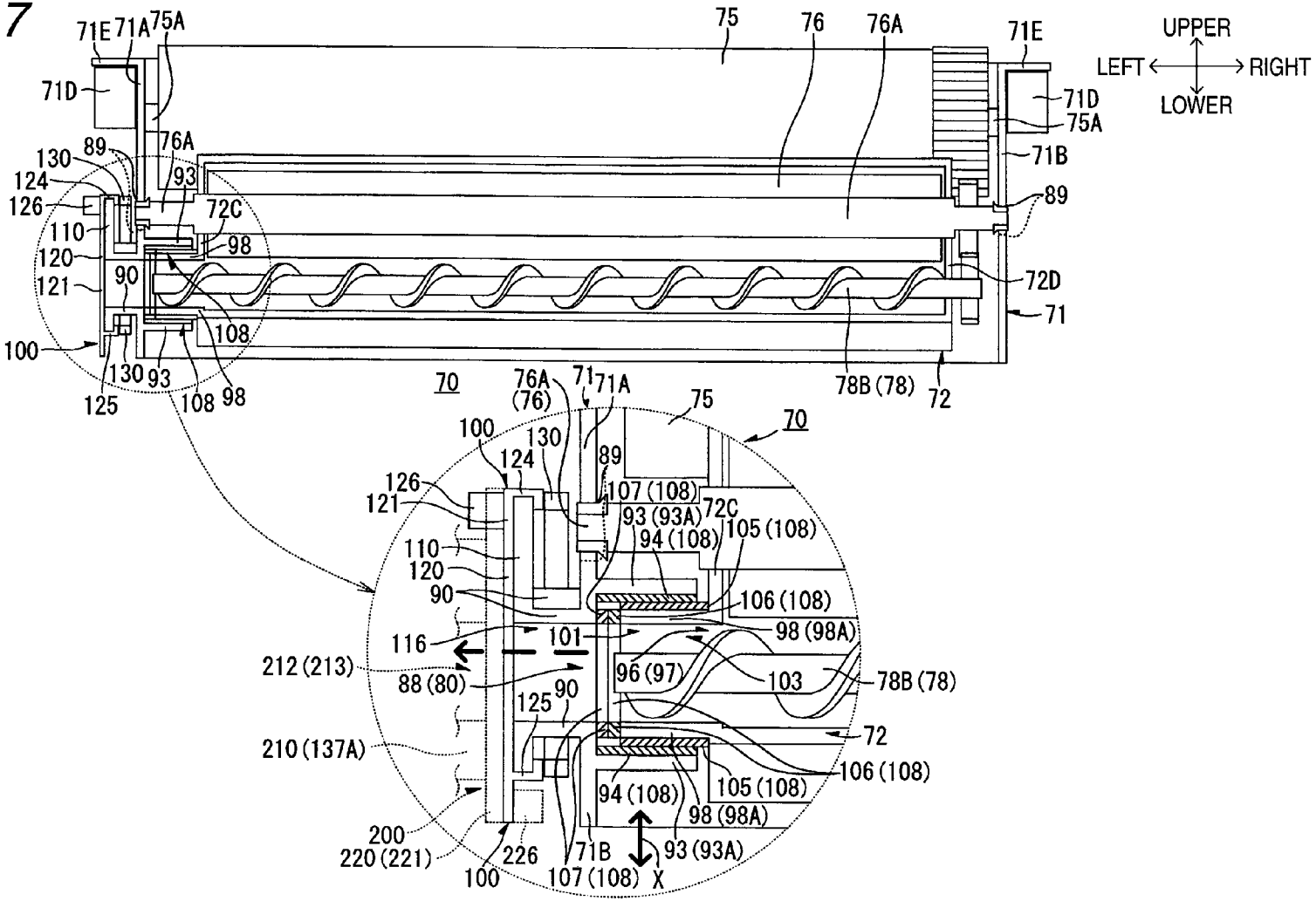
FIG. 7 is a sectional view taken along the line B-B of FIG. 1, showing a portion corresponding to the process cartridge.
Figure 8:
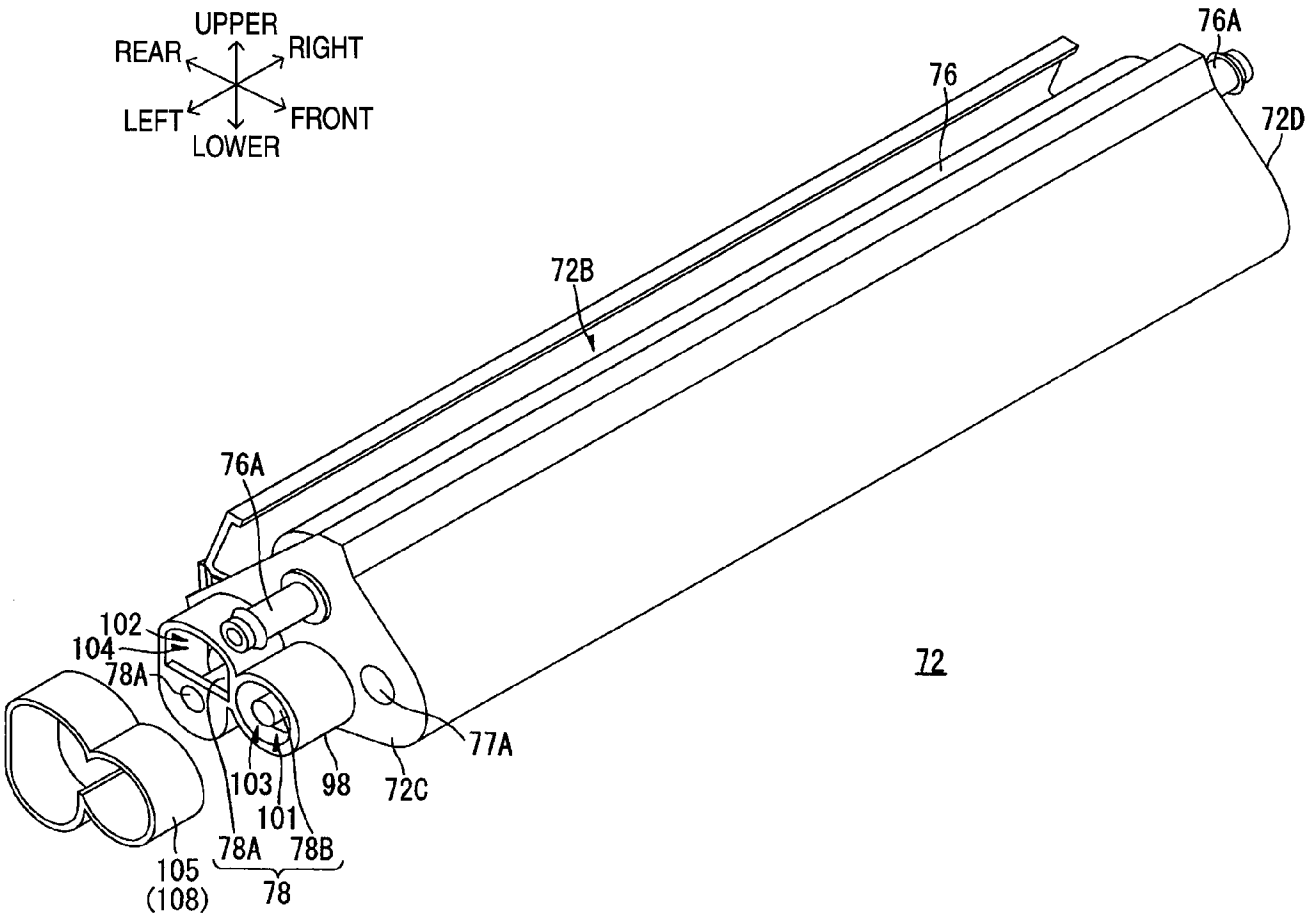
FIG. 8 is an exploded perspective view of the second housing as viewed form the left front side.

FIG. 5 is a perspective view of the second housing as viewed from a left front. FIG. 6 is a sectional view taken along the line A-A of FIG. 1, showing a portion corresponding to the process cartridge. FIG. 7 is a sectional view taken along the line B-B of FIG. 1, showing a portion corresponding to the process cartridge. FIG. 8 is an exploded perspective view of the second housing as viewed form the left front side.

As shown in FIG. 5, the second housing 72 has a hollow box shape which is elongated in the width direction. The second housing 72 is narrowed as it extends upwards, and an exposing hole 72B is formed at an upper end portion thereof to elongate in the width direction. The upper outer circumferential surface of the developing roller 76 is exposed from the exposing hole 72B so as to confront the lower outer circumferential surface of the photosensitive drum 75 (refer to FIG. 1).

A left end portion of a rotational shaft 76A of the developing roller 76 is exposed from a left-hand side wall 72C, as an example of a second wall, of the second housing 72 and projects to the left. A right end portion of the rotational shaft 76A is exposed from a right-hand side wall 72D of the second housing 2 and projects to the right. A left end portion of a rotational shaft 77A of the supply roller 77 is exposed from the left-hand side wall 72C at a position obliquely forwards and downwards of the left end portion of the rotational shaft 76A of the developing roller 76. Similarly, a right end portion of the rotational shaft 77A is exposed from the right-side wall 72D (not shown).

Two through holes, i.e. a second supply hole 95 (see FIG. 6) and a second discharge hole 96 (see FIGS. 5 and 7), are formed through the left-hand side wall 72C of the second housing 72 in an area obliquely rearwards and downwards of the rotational shaft 76A of the developing roller 76 and the rotational shaft 77A of the supply roller 77. The second supply hole 95 and the second discharge hole 97 are collectively referred to as a second opening 97. As will be described later, toner passes through the second opening 97.

The second discharge hole 96 is a round hole. As shown in FIG. 7, a left end portion of the second auger 78B is inserted into the second discharge hole 96. The second supply hole 95 is also a round hole and is disposed adjacent to the second discharge hole 96 in an obliquely rearward and downward direction, although it is not specifically shown. As shown in FIG. 6, a left end portion of the first auger 78A is inserted into the second supply hole 95.

As shown in FIGS. 5 and 8, a second boss 98 as an example of a second edge portion is provided integrally on a left surface of the left-hand side wall 72C. The second boss 98 is a hollow element made from a resin and having a substantially 8-shape as viewed from the left-hand side and projects leftwards from the left surface of the left-hand side wall 72C while surrounding both the second supply hole 95 and the second discharge hole 96. The second supply hole 95 and the second discharge hole 96 are separated from each other in an inside of the second boss 98. That is, the second boss 98 is configured to function as a surrounding wall surrounding the second supply hole 95 and the second discharge hole 96 and also function as a partition wall partitioning the second supply hole 95 and the second discharge hole 96 one from another.

Two openings, i.e. a front opening 101 and a rear opening 102, are formed in a left end surface of the second boss 98 to be adjacent to one another in the longitudinal direction. The front opening 101 is a round hole which is substantially the same in size as the second discharge hole 96. As shown in FIG. 7, the front opening 101 is located at a left-hand side of the second discharge hole 96 to confront the second discharge hole 96. The front opening 101 communicates with the second discharge hole 96 via a front passage 103 formed in an inside of the second boss 98 (see FIGS. 5 and 7). The left end portion of the second auger 78B which is inserted into the second discharge hole 96 is disposed in the front passage 103. On the other hand, the rear opening 102 has a semicircular shape (refer to FIG. 5) which is swollen upwards, and is situated leftwards and upwards of the second supply hole 95 as shown in FIG. 6. The rear opening 102 communicates with the second supply hole 95 via a rear passage 104 formed in the inside of the second boss 98. The left end portion of the first auger 78A which is inserted into the second supply hole 95 is disposed in the rear passage 104. As shown in FIG. 8, the left end portion of the first auger 78A is supported by the left end face of the second boss 98 at a position downwards from the rear opening 102. The second boss 98 is so configured as to block a communication between the front passage 103 and the rear passage 104. Accordingly, the second supply hole 95 (refer to FIG. 6) and the second discharge hole 96 (refer to FIG. 7) are separated from each other in the inside of the second boss 98.

In this way, the second boss 98 bounds the second supply hole 95 and second discharge hole 96 (collectively referred to as the second opening 97) on the second housing 72 (specifically, on the left-hand side wall 72C) (refer to FIGS. 6 and 7). The end portion (the left end portion in the width direction) of the conveying auger 78 (the end portions of the first auger 78A and the second auger 78B) is disposed in the inside (the rear passage 104 and the front passage 103) of the second boss 98 (a second portion 98A described later) (refer to FIGS. 6 and 7).

As shown in FIG. 5, a second elastic element 105 formed of a sponge material is bonded to an outer circumferential surface (an area excluding the left end face of the second boss 98) of the second boss 98. Specifically, the second elastic element 105 has a ring shape which surrounds an outer circumferential surface of the second boss 98 and fits on the second boss (refer to FIG. 8). A third elastic element 106 formed of a sponge material or the like is bonded to the left end face of the second boss 98 to surround the front opening 101 and the rear opening 102.

(3) Attachment of Second Housing to First Housing

An attachment of the second housings 72 to the first housing 71 will be described. Note that since the four second housings 72 are provided as has been described above (refer to FIG. 1), an attachment procedure of attaching the second housing 72 to the first housing 71 will be repeated the number of times which corresponds to the number of second housings 72 provided.

The second housing 72 is held in the width direction by the left-hand side wall 71A and right-hand side wall 71B (FIG. 3(*c*)) of the first housing 71 in the following fashion:

The second boss 98 (FIG. 5) of the second housing 72 is fitted into the inside of the corresponding first boss 93 (FIG.

4) on the left-hand side wall 71A of the first housing 71 from the right-hand side. Consequently, as shown in FIGS. 6 and 7, the second elastic element 105 bonded to the outer circumferential surface of the second boss 98 is closely contacted with the first elastic element 94 bonded to the inner circumferential surface of the first boss 93. The third elastic element 106 bonded to the left end face of the second boss 98 is brought into press contact with a portion, surrounded by the first boss 93, of the right side surface of the left-hand side wall 71A of the first housing 71. Specifically, because a fourth elastic element 107 made of a sponge material is bonded to that portion, surrounded by the first boss 93, of the right side surface of the left-hand side wall 71A of the first housing 71, the third elastic element 106 is closely contacted with the fourth elastic element 107. The fourth elastic element 107 is configured to surround the first supply hole 87 and the first discharge hole 88, When the first elastic element 94, the second elastic element 105, the third elastic element 106 and the fourth elastic element 107 are collectively referred to as an elastic element 108, the elastic element 108 fills a gap between the second boss 98 and the first boss 93 because the second elastic element 105 is closely contacted with the first elastic element 94 and the third elastic element 106 is closely contacted with the fourth elastic element 107.

Since the second boss 98 of the second housing 72 is fitted into the inside of the first boss 93 of the first housing 71, the first boss 93 has a first portion 93A overlapping the second boss 98 in the width direction, and the second boss 98 has a second portion 98A overlapping the first portion 93A in the width direction. Since the second boss 98 is fitted into the inside of the first boss 93, the second portion 98A is disposed in an inside of the first portion 93A. The first portion 93A projects rightwards towards the left-hand side wall 72C of the second housing 72, and the second portion 98A projects leftwards towards the left-hand side wall 71A of the first housing 71. The elastic element 108 (specifically, the first elastic element 94 and the second elastic element 105) is held by the first portion 93A and the second portion 98A in the orthogonal direction X.

When the second portion 98A is disposed in the inside of the first portion 93A, at the boss 98, the front opening 101 (FIG. 5) of the boss 98 confronts and communicates with the corresponding first discharge hole 88 (FIG. 4) of the left-hand side wall 71A of the first housing 71 from the right hand side, and the rear opening 102 (FIG. 5) of the boss 98 confronts and communicates with the corresponding first supply hole 87 (FIG. 4) of the left-hand side wall 71A from the right hand side as shown in FIGS. 6 and 7. Consequently, as shown in FIG. 7, the first discharge hole 88 of the first housing 71 communicates with the second discharge hole 96 of the second housing 72 via the front opening 101 and front passage 103 of the second boss 98. Similarly, as shown in FIG. 6, the first supply hole 87 of the first housing 71 communicates with the second supply hole 95 of the second housing 72 via the rear opening 102 and rear passage 104 of the second boss 98.

Further, when the second portion 98A is disposed in the inside of the first portion 93A, the left end portion of the rotational shaft 76A of the developing roller 76, which is exposed from the left-hand side wall 72C of the second housing 72 as shown in FIG. 5, is loosely fitted to the corresponding insertion hole 89 (FIG. 4) of the left-hand side wall 71A of the first housing 71. Similarly, the right end portion of the rotational shaft 76A of the developing roller 76, which is exposed from the right-hand side wall 72D of the second housing 72, is loosely fitted to the corresponding insertion hole 89 of the right-hand side wall 71B (FIG. 3(*c*)) of the first housing 71.

The attachment of the second housing 72 to the first housing 71 is completed in this way.

As has been described before, each of the though holes 89 has the overall shape which is elongated obliquely rearwards and upwards and obliquely forwards and downwards (FIG. 4). Accordingly, when the left and right end portions of the rotational shaft 76A of the developing roller 76 are loosely fitted to the insertion holes 89 as shown in FIG. 7, the rotational shaft 76A is supported by the insertion holes 89 to be moveable in the longitudinal direction of the insertion holes 89 (obliquely rearwards and upwards and obliquely forwards and downwards, the aforesaid orthogonal direction X). Accordingly, the second housing 72 supporting the developing roller 76 is attached to and supported by the first housing 71 to be movable in the orthogonal direction X relative to the first housing 71. That is, the developing roller 76 on the second housing 72 is moveable in the orthogonal direction X relative to the photosensitive drum 75 on the first housing 71. In this connection, the second boss 98 of the second housing 72 is fitted to the inside of the first boss 93 of the first housing 71 via the elastic element 108 to be moveable in the orthogonal direction X relative to the first boss 93 within the first boss 93 depending on the relative movement of the second housing 72 to the first housing 71.

Even when the second boss 98 is moved relative to the first boss 93, the gap between the second boss 98 and the first boss 93 is filled with the elastic element 108. That is, the elastic element 108 permits the relative movement of the second discharge hole 96 of the second housing 72 to the first discharge hole 88 of the first housing 71 and the relative movement of the second supply hole 95 of the second housing 72 to the first supply hole 87 of the first housing 71, while maintaining a state in which the first discharge hole 88 communicates with the second discharge hole 96 and the first supply hole 87 communicates with the second supply hole 95 (see FIGS. 6 and 7). In other words, the relative movement of the second opening 97 to the first opening 80 is permitted, while maintaining a state in which the first opening 80 (corresponding one of the first supply hole 87 and the first discharge hole 88) and the second opening 97 (corresponding one of the second supply hole 95 and the second discharge hole 96) communicate with each other.

An elastic element 55 (FIG. 1) such as a spring is interposed between the first housing 71 and the second housing 72 to urge the second housing 72 obliquely rearwards and upwards i.e. in the orthogonal direction X toward the first housing 71. Accordingly, the developing roller 76 is urged toward the photosensitive drum 75 (FIG. 1). The elastic element 55 is supported by the first housing 71.

(4) First Shutter

FIG. 9, (a) is an exploded perspective view of a portion of the first housing around the left-hand side wall as viewed from a left front side, and FIG. 9(*b*) is an assembled perspective view of that as viewed from the left front side.

As shown in FIGS. 9(*a*) and 9(*b*), the process cartridge 70 has a first shutter 100 disposed on the left side surface of the left-hand side wall 71A of the first housing 71 (that is, an external surface of the process cartridge 70). As will be described later, the shutter 100 opens and closes the first openings 80 and the second openings 97 (FIGS. 6 and 7).

The first shutter 100 includes a single pieces of a first shutter supporting wall 110 (FIG. 9(*a*)) attached to the left-hand side wall 71A. The first shutter supporting wall 110 has a longitudinally elongated rectangular plate shape as viewed from the left-hand side and is connected to left end portions of the four outer bosses 90 projecting leftwards from the left side surface of the left-hand side wall 71A. Accordingly, the first shutter supporting wall 110 is disposed leftwards from the left-hand side wall 71A and spaced apart from the left-hand side wall 71A with a predetermined interval.

As shown in FIG. 9(*a*), two through holes, i.e. a third supply hole 115 and a third discharge hole 116, are formed through the first shutter supporting wall 110 at a location where the left end portion of the outer boss 90 is connected. The third supply hole 115 has a semicircular shape which is swollen upwards. The third discharge hole 116 is a round hole and is disposed at a front side of the third supply hole 115. In an interior of the outer boss 90, the first supply hole 87 confronts and communicates with the third supply hole 115 as shown in FIG. 6, and the first discharge hole 88 confronts and communicates with the third discharge hole 116 as shown in FIG. 7.

Four fifth elastic elements 117, made of a sponge material or the like, are bonded to a left side surface of the first shutter supporting wall 110 so that each fifth elastic element 117 bounds a corresponding pair of the third supply hole 115 and the third discharge hole 116. The fifth elastic element projects leftwards from the left side surface of the first shutter supporting wall 110.

The first shutter 100 is integrally provided with a supporting frame 130, a grip 132 and four first covers 120.

The supporting frame 130 is a longitudinally elongated rectangular frame shape which is similar to an outer peripheral contour of the first shutter supporting wall 110 as viewed from the left-hand side.

The grip 132 has a hook shape which extends continuously from a front end of the supporting frame 130 forwards, downwards and then slightly rearwards. A portion of the grip 132, which extends slightly rearwards, is referred to as a distal end portion 132A of the grip 132.

The first cover 120 includes an integral vertical wall 121, upper claw 124 and lower claw 125. The vertical wall 121 has a thin plate-like shape substantially square as viewed from the left-hand side. The upper claw 124 extends rightwards from an upper end of the vertical wall 121 and is then bent downwards. The lower claw 125 extends rightwards from a lower end of the vertical wall 121 and is then bent upwards.

Two cylindrical projections 126 project leftwards from an upper portion of the vertical wall 121. The cylindrical projections 126 are aligned in the longitudinal direction. Two recessed portions 127 are recessed upwards from a lower edge of the vertical wall 121. The recessed portions 127 at a lower portion of the vertical wall 121 are aligned in the longitudinal direction. The front projection 126 and the front recessed portion 127 overlap each other as viewed from the vertical direction, and the rear projection 126 and the rear recessed portion 127 overlap each other as viewed from the vertical direction.

The four first covers 120 are attached to the supporting frame 130 from the left-hand side to be spaced apart at predetermined intervals in the longitudinal direction. Specifically, each of the first cover 120 is attached such that a right end face of the upper claw 124 is connected to an upper edge of the supporting frame 130 and a right end face of the lower claw 125 is connected to a lower edge of the supporting frame 130. Accordingly, the first cover 120 extends between the upper edge and the lower edge of the supporting frame 130. The first shutter 100 thus configured defines spaces 118 which penetrate through the first shutter 100 in its width direction and which are located between the adjacent first covers 120 and between the frontmost first cover 120 and the grip 132.

As shown in FIG. 9(*b*), the first shutter 100 is attached to the first shutter supporting wall 110. Specifically, the first cover 120 of the first shutter 100 is disposed, as shown in FIGS. 6 and 7, such that the vertical wall 121 is disposed adjacent to a left-hand side of the first shutter supporting wall 110, the upper claw 124 is brought into engagement with an upper edge of the first shutter supporting wall 110 from above, and the lower claw 125 is brought into engagement with a lower edge of the first shutter supporting wall 110 from below. That is, the four first covers 120 hold the first shutter supporting wall 110 in the vertical direction by their upper claws 124 and lower claws 125 (FIG. 9(*b*)). The supporting frame 130 is disposed at a right-hand side of the first shutter supporting wall 110 and at a left-hand side of the left-hand wall 71A of the first housing 71.

Accordingly, the first shutter 100 is supported by the first shutter supporting wall 110 to be slidable in the longitudinal direction. When a user grips and moves the grip 132 in the longitudinal direction, the first shutter 100 is also moved in the longitudinal direction. Accordingly, the first shutter 100 can be moved to a frontmost side to take a closed position as shown in FIG. 3(*a*), and can be moved to a rearmost side to take an open position as shown in FIG. 3(*b*).

As shown in FIG. 3(*a*), when the first shutter 100 is in the closed position, each of the first covers 120 closes a corresponding pair of third supply holes 115 and third discharge holes 116 of the first shutter supporting wall 110 from the left-hand side. Accordingly, as shown in FIGS. 6 and 7, the first cover 120 can close the first supply hole 87 communicating with the third supply hole 115, the second supply hole 95 communicating with the first supply hole 87, the first discharge hole 88 communicating with the third discharge hole 116 and the second discharge hole 96 communicating with the first discharge hole 88 from the left-hand side. Therefore, the interior of the second housings 72 are tightly closed. In this state, since a gap between the cover 120 and the first shutter supporting wall 110 are blocked by the fifth elastic elements (FIG. 9(*a*)), the third supply hole 115 and the third discharge hole 116 are tightly closed at the left-hand side of the first shutter supporting wall 110.

When the first shutter 100 is in the open position shown in FIG. 3(*b*), each of the first covers 120 is offset rearwards from the corresponding pair of third supply holes 115 and third discharge holes 116, and therefore all of the third supply holes 115 and the third discharge holes 116 are opened via the spaces 118 (FIG. 9(*a*)) of the first shutter 100. Consequently, the first supply holes 87, the second supply holes 95, the first discharge holes 88 and the second discharge holes 96 (FIGS. 6 and 7) are opened to the left-hand side. This way, the interior of each second housing 72 communicates with the exterior via the first supply hole 87, the second supply hole 95, the third supply hole 115, the first discharge hole 88, the second discharge hole 96 and the third discharge holes 116 (FIGS. 6 and 7).

3. Guide Portions and Second Shutter

Figure 10:
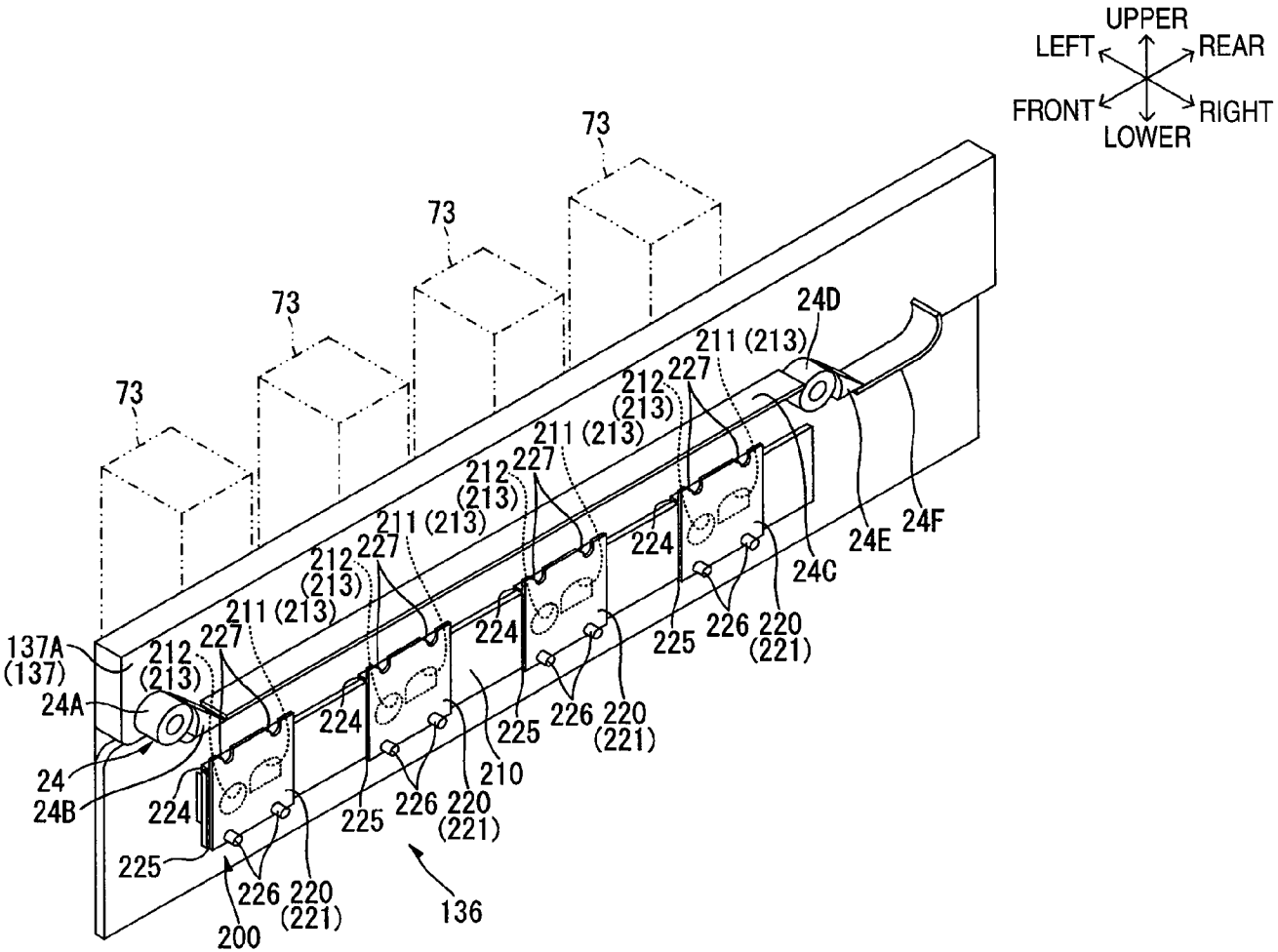
FIG. 10 is a perspective view of a portion of a casing around a partition wall as viewed from a right front side.

FIG. 10 is a perspective view of a portion of the apparatus casing around a partition wall as viewed from a right front side.

The casing 1 (FIG. 1) defines, as a part of an interior thereof, a cartridge accommodation chamber 136 for accommodating the process cartridge 70. More specifically, as shown in FIG. 10, the casing 1 includes a pair of casing walls 137 (only a left-hand casing wall (partition wall) 137A is illustrated in FIG. 10) for defining the cartridge accommodation chamber 136 in the left-right or transverse direction. The partition wall 137A is disposed between the toner boxes 73 and the process cartridge 70 (not shown in FIG. 10). Guide portions 24 are provided respectively on opposing surfaces of the partition walls 137. In FIG. 10, the guide portion 24 on a right side surface of the left partition wall 137A is illustrated. A second shutter 200 is disposed on the right side surface of the partition wall 137A.

(1) Guide Portions

Each of the guide portions 24 includes a first guide roller 24A, a first inclined wall 24B, a first guide rail 24C, a second guide roller 24D, a second inclined wall 24E and a second guide rail 24F, which are arranged in this order from the front side.

The first guide roller 24A is rotatably supported on each casing wall 137.

The guide rail 24C has a plate shape, and extends in the front-back or longitudinal direction substantially at the same vertical height as a lower portion of the first guide roller 24A. The first inclined wall 24B has an inclined surface inclined from an upper portion of the first guide roller 24A towards an upper surface of the first guide rail 24C.

The second guide roller 24D is rotatably supported on each casing wall 137. The second guide roller 24D is disposed such that the upper portion thereof is located substantially at the same vertical height as the first guide rail 24C. The second guide rail 24F has a plate shape, and extends in the longitudinal direction and is then curved upwards at a rear end portion thereof. The second guide rail 24F is disposed so that the upper surface of the longitudinally extending portion thereof is located substantially at the same vertical height as a lower portion of the second guide roller 24D. The second inclined wall 24E has an inclined surface inclined from an upper portion of the second guide roller 24D towards the upper surface of the second guide rail 24F.

(2) Second Shutter

The second shutter 200 is disposed below the guide portion 24 on the right side surface of the partition wall 137A. The second shutter 200 includes four second covers 220.

For the second shutter 200, a second shutter supporting wall 210 is disposed on the partition wall 137A.

The second shutter supporting wall 210 is similar in shape to the first shutter supporting wall 110 (FIG. 9(*a*)) and has a longitudinally elongated rectangular plate shape as viewed from the right-hand side. The second shutter supporting wall 210 is attached to the right side surface of the partition wall 137A. Four pairs of through holes are formed through the second shutter supporting wall 210 at predetermined intervals in the longitudinal direction each pair including two through holes, i.e. a fourth supply hole 211 and a fourth discharge hole 212. The fourth supply hole 211 has a semicircular shape which is swollen upwards. The fourth discharge hole 212 is a round hole disposed in front of the fourth supply hole 211. The fourth supply hole 211 and the fourth discharge hole 212 penetrate through not only the second shutter supporting wall 210 but also the partition wall 137A so as to communicate with an interior of the corresponding toner box 73. In the following description, the fourth supply hole 211 and the fourth discharge hole 212 are collectively referred to as a passage opening 213.

The second shutter 200 includes second covers 220. Each second cover 220 includes an integral vertical wall 221, upper claw 224 and lower claw 225. The vertical wall 221 has a thin plate-like shape substantially square as viewed from the right-hand side. The upper claw 224 extends leftwards from an upper end of the vertical wall 221 and is then bent downwards. The lower claw 225 extends leftwards from a lower end of the vertical wall 221 and is then bent upwards.

Two cylindrical projections 226 project rightwards from a lower portion of the vertical wall 221 to be aligned in the longitudinal direction. Two recessed portions 127 at an upper portion of the vertical wall 221 are recessed downwards from an upper edge of the vertical wall 221 to be aligned in the longitudinal direction. The front projection 226 and the front recessed portion 227 overlap each other as viewed in the vertical direction, and the rear projection 226 and the rear recessed portion 227 overlap each other as viewed in the vertical direction.

The four second covers 220 of the second shutter 200 are attached to the second shutter supporting wall 210 from the right-hand side to be spaced apart at predetermined intervals in the longitudinal direction. Specifically, each second cover 220 of the second shutter 200 is attached such that the vertical wall 221 is disposed adjacent to a right-hand side of the second shutter supporting wall 210, the upper claw 224 is brought into engagement with an upper edge of the second shutter supporting wall 210 from above and the lower claw 225 is brought into engagement with a lower edge of the second shutter supporting wall 210 from below. That is, the four second covers 220 hold the second shutter supporting wall 210 in the vertical direction by their upper claws 224 and lower claws 225.

Accordingly, the second shutter 200 is supported by the second shutter supporting wall 210 to be sidable in the longitudinal direction. Consequently, the second shutter 200 can be moved to a frontmost side to take a closed position (FIG. 10), and can be moved to a rearmost side to take an open position (not shown). The state in which the four second covers 220 are spaced apart at predetermined intervals in the longitudinal direction is maintained at all times whether or not the second shutter 200 is moved.

As shown in FIG. 10, when the second shutter 200 is in the closed position, the second covers 220 close respective pairs of fourth supply holes 211 and fourth discharge holes 212 of the second shutter supporting wall 210 from the right-hand side. When the second shutter 200 is in the open position, the second covers 220 are offset rearwards from the respective pairs of fourth supply holes 211 and fourth discharge holes 212, so that the fourth supply holes 211 and the fourth discharge holes 212 are opened to the right-hand side.

In this way, the second shutter 200 opens and closes the passage openings 213 (the fourth supply holes 211 and the fourth discharge holes 212). With reference to FIGS. 6 and 7, when both the first shutter 100 and the second shutter 200 are moved to the open positions, a gap corresponding to a total thickness of the first shutter 100 and the second shutter 200 is produced between the first shutter supporting wall 110 and the second shutter supporting wall 210. However, this gap is blocked by the fifth elastic element 117 (FIGS. 3(*b*) and 9) because the fifth elastic member 117 is out of contact with the first shutter 100 and thus released from the compressed state. Additional elastic elements may be provided between the second shutter 200 and the second shutter supporting wall 210.

4. Attachment and Detachment of Process Cartridge to and from Body Casing

Figure 11:
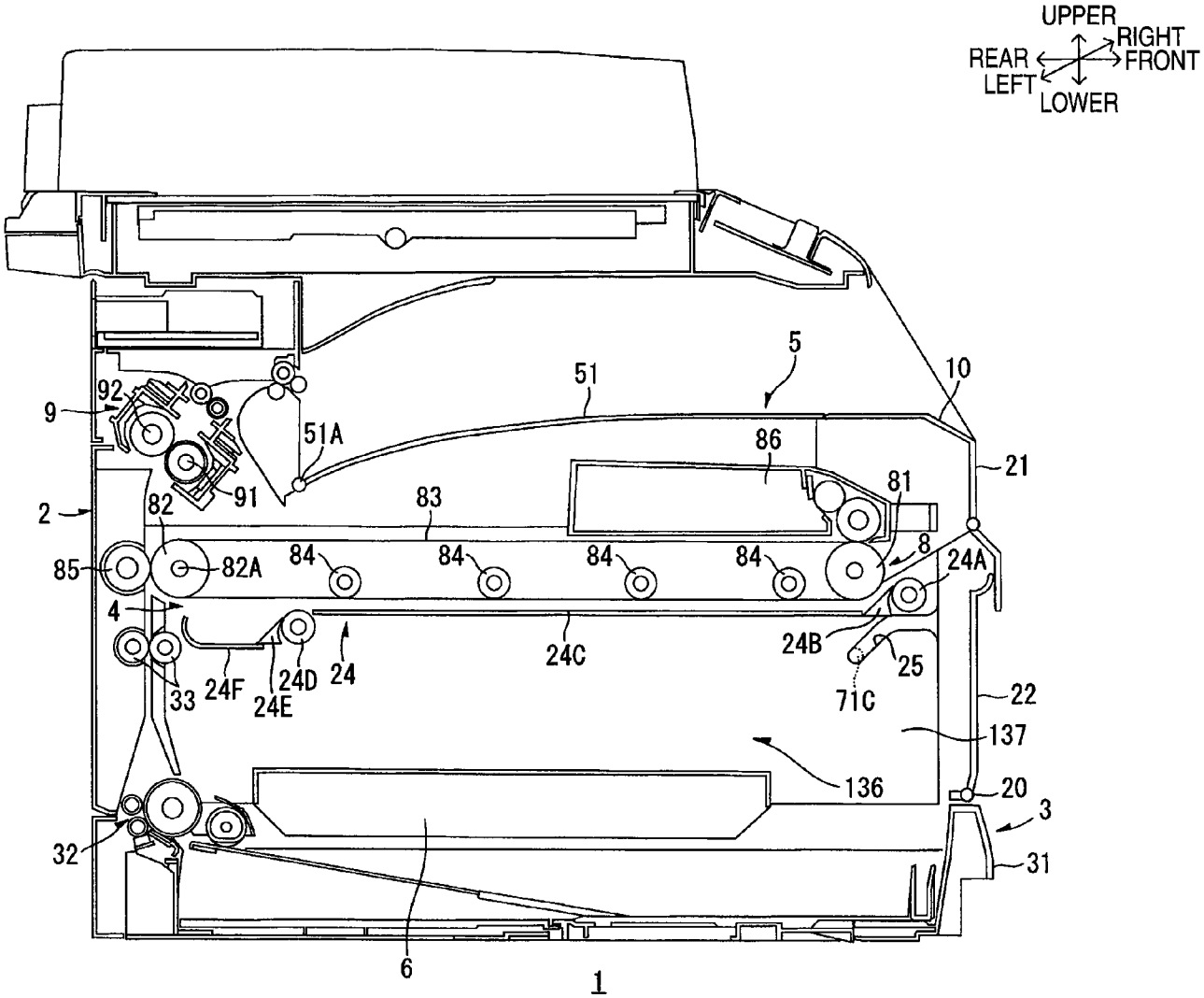
FIG. 11 is a left side sectional view of the color printer with the process cartridge unloaded therefrom.
Figure 12:
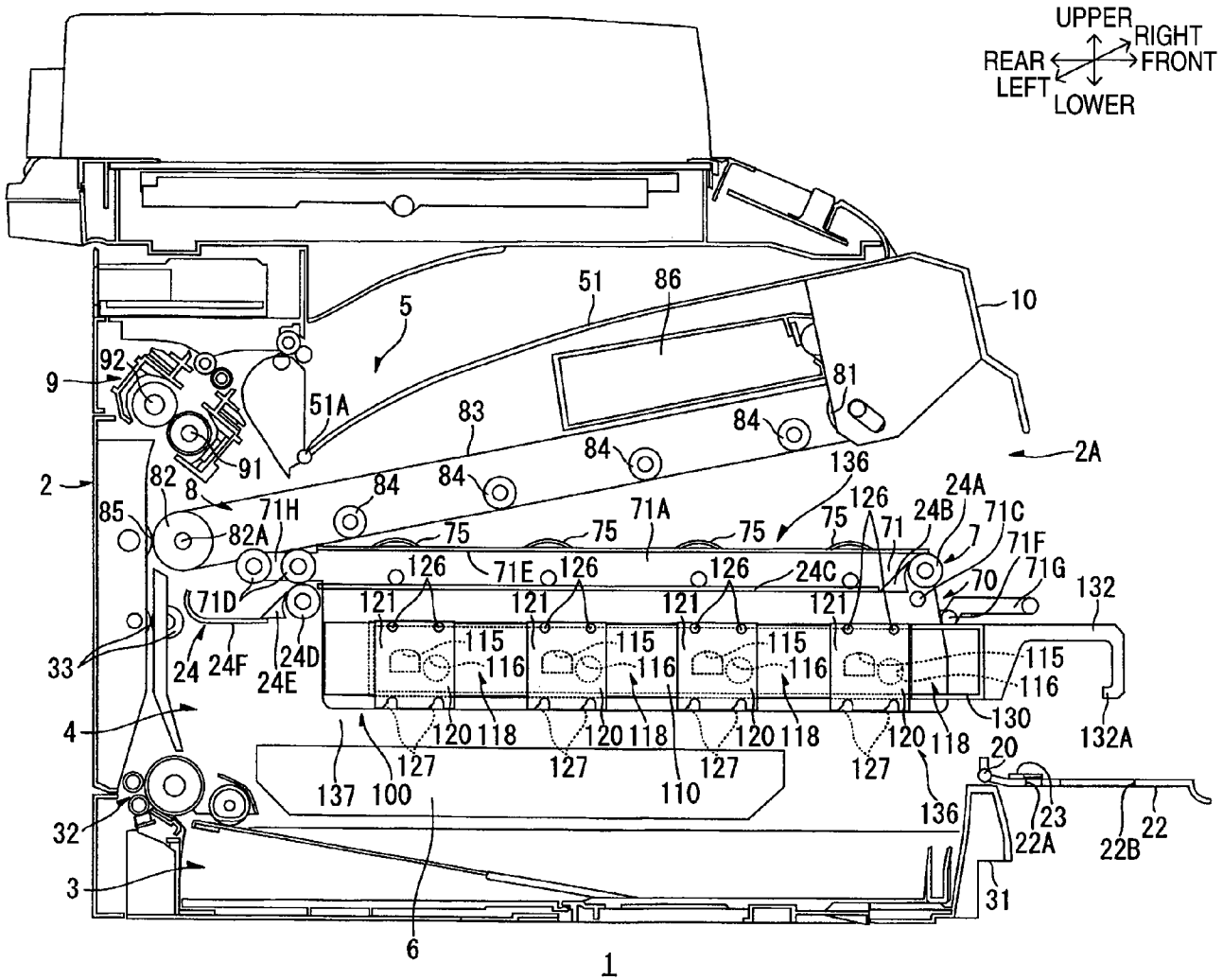
FIG. 12 is a left side sectional view of the color printer in a state that the process cartridge is being attached to or detached from the color printer with a top cover and a second front cover opened.
Figure 13:
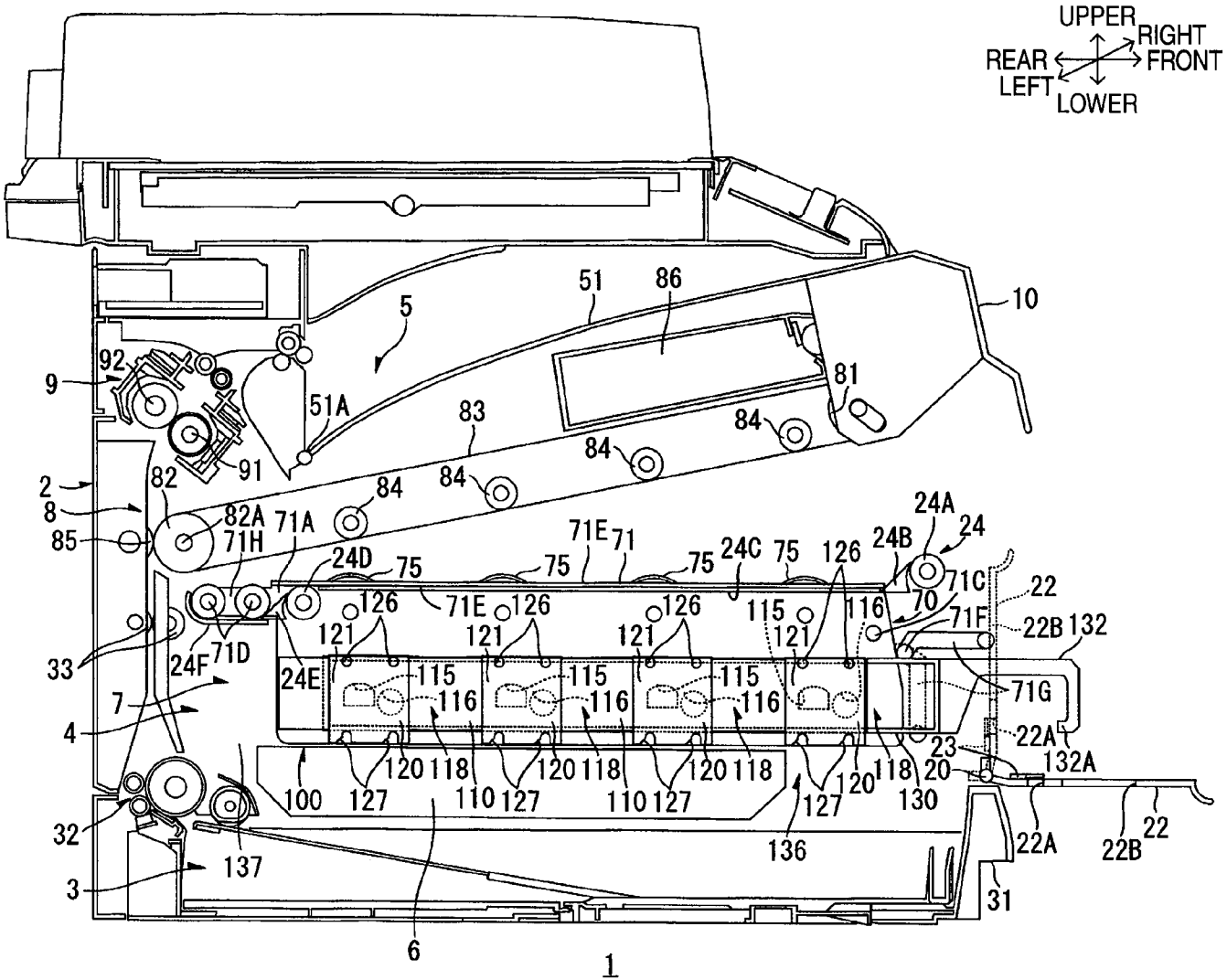
FIG. 13 shows a state in which the attachment of the process cartridge is completed in FIG. 12.
Figure 14:
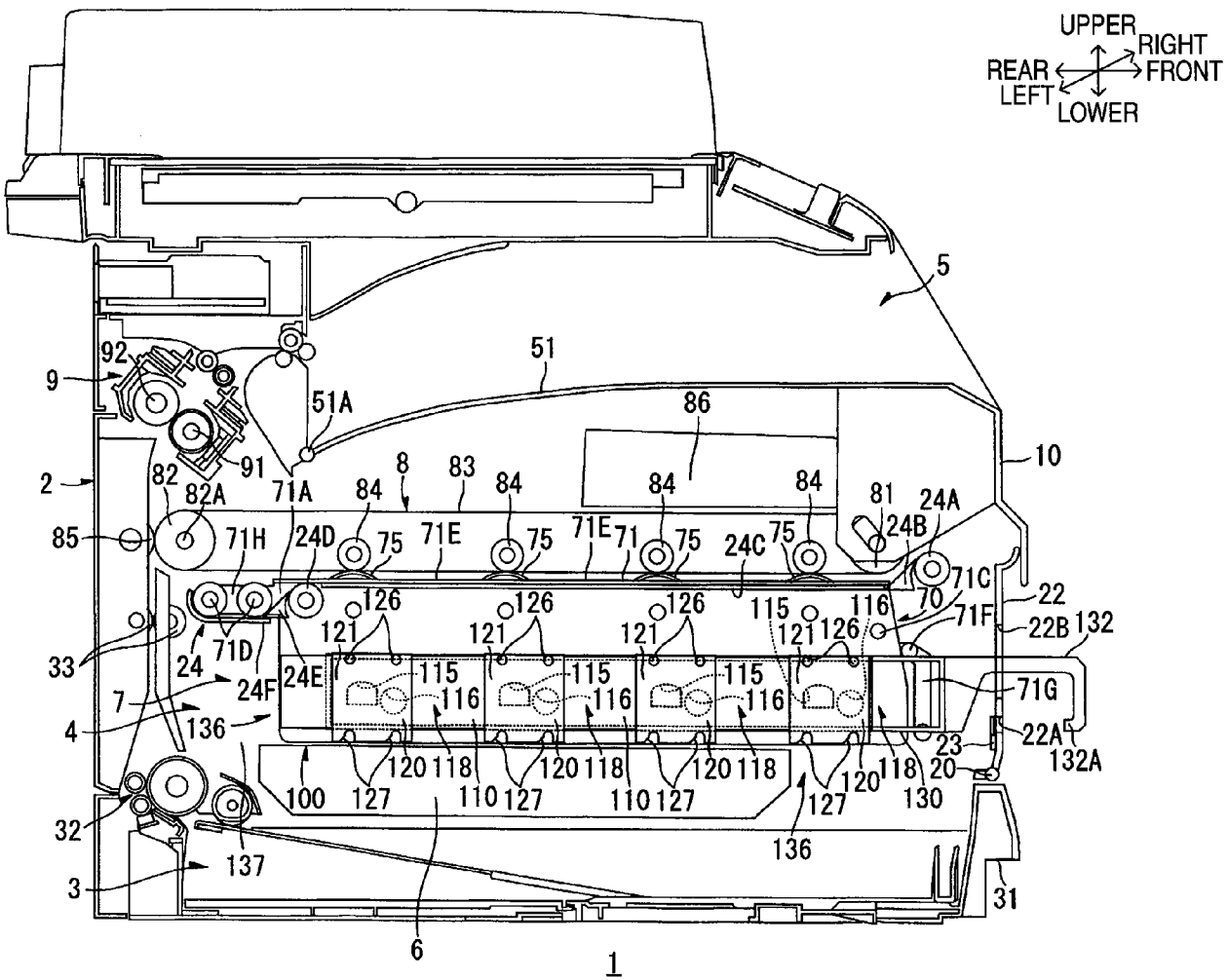
FIG. 14 shows a state in which the top cover and the second front cover are closed in FIG. 13.
Figure 15:
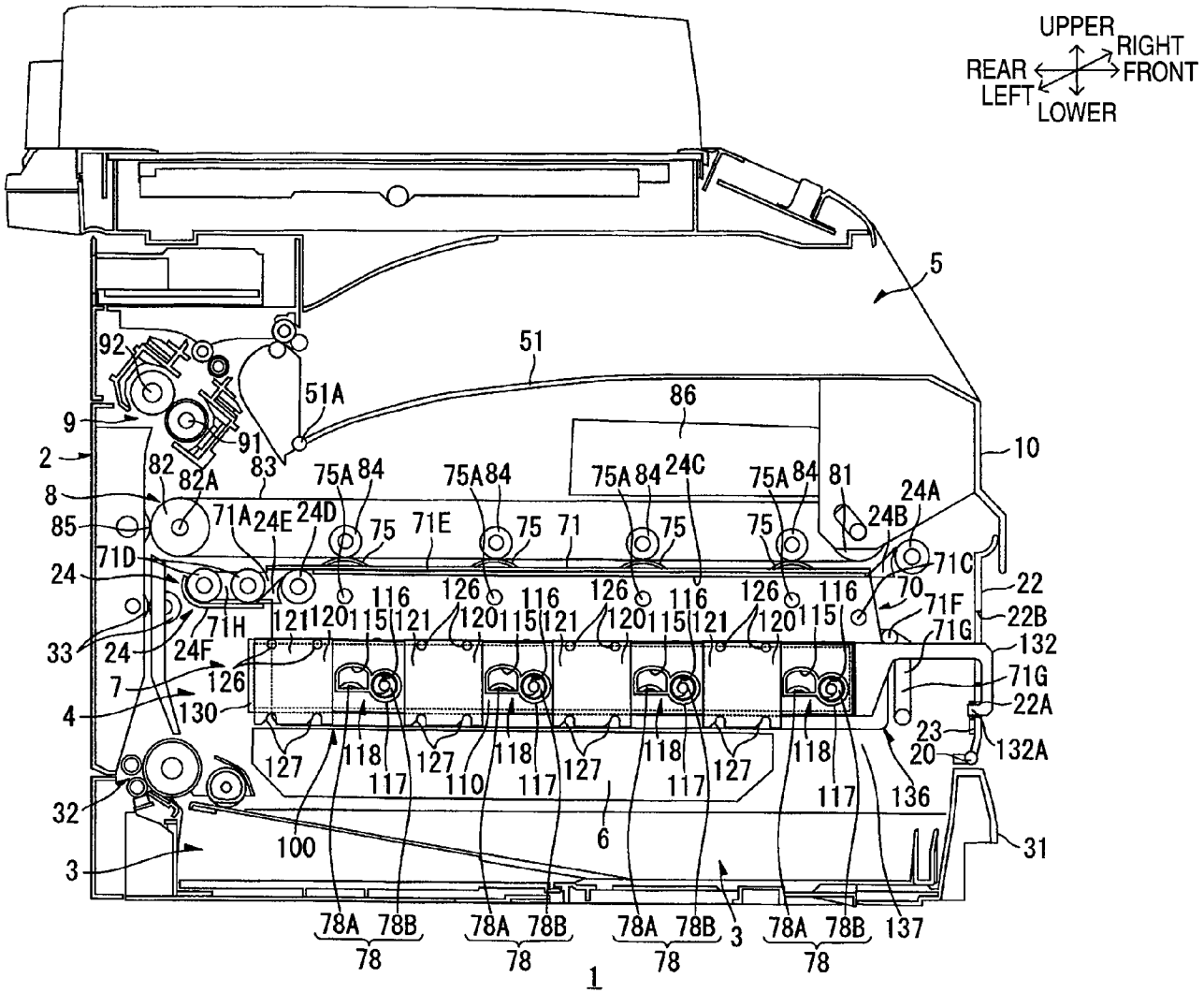
FIG. 15 shows a state in which the first shutter is moved to the open position in FIG. 14.

FIG. 11 is a left side sectional view of the color printer with the process cartridge unloaded therefrom. FIG. 12 is a left side sectional view of the color printer in such a state that the process cartridge is being attached to or detached from the color printer with a top cover and a second front cover 22 opened. FIG. 13 shows a state in which the attachment of the process cartridge is completed in FIG. 12. FIG. 14 shows a state in which the top cover and the second front cover are closed in FIG. 13. FIG. 15 shows a state in which the first shutter is moved to the open position in FIG. 14.

As shown in FIG. 11, a second front cover 22 is provided at a front side of the body casing 2 to be opened and closed freely. The second front cover 22 in a closed position is erected. A rotational shaft 20 is provided at a lower end portion of the second front cover 22. When the second front cover 22 in the closed position is pulled forwards, the second front cover 22 is rotated around the rotational shaft 20 to fall forwards (see FIG. 13). Accordingly, the second front cover 22 is opened. As shown in FIG. 13, the second cover 22 is formed with a first insertion hole 22A and a second insertion hole 22B that are arranged in this order from the rotational shaft 20. A photosensor 23 is disposed in the vicinity of the first insertion hole 22A on the second front cover 22. Specifically, this photosensor 23 includes a light emitting element for emitting light toward the first insertion hole 22A and a light receiving element for receiving the emitted light passing across the first insertion hole 22A. The photosensor 23 detects whether or not the first shutter 100 is in the open position by determining whether or not the light is blocked, as will be described later.

The casing 2 has a top cover 10 located above the second front cover 22. As shown in FIG. 11, the top cover 10 is overlaid on the second front cover 22 in the closed state as shown in FIG. 11. The top cover 10 is an integrated assembly including the sheet discharging tray 51 and components of the casing 2 located above the sheet discharging tray 51. The first front cover 21 (see, for example, FIG. 1) is also included in the top cover 10. A front lower end portion of the top cover 10 is brought into abutment with an upper end portion of the second front cover 22 to restrict the rotational forward movement of the second front cover 22 This way, the second front cover 22 is held in the closed state.

As shown in FIG. 13, the top cover 10 can swing vertically about a rotational shaft 82A of the driven roller 82 of the transfer part 8 and also about a shaft 51A provided at a rear of the sheet discharging tray 51.

Hereinafter, how the process cartridge 70 is attached to and detached from the casing 2 will be described.

(1) Attachment of Process Cartridge to Casing

Firstly, in a state in which the process cartridge 70 is not installed in the body casing 2 as shown in FIG. 11, the top cover 10 is swung upwards and thereafter the second front cover 22 is rotated forwards and downwards to provide an opening 2A at the front side of the casing 2. The process cartridge 70 is inserted through the opening 2A as shown in FIG. 12. This opening 2A communicates with the cartridge accommodation chamber 136 (FIG. 10).

The process cartridge 70, inserted through the opening 2A, is guided rearwards along the guide portions 24 from the opening 2A. As this time, both the first shutter 100 of the process cartridge 70 and the second shutter 200 (FIG. 10) of the casing 2 are in the closed positions.

During the insertion of the process cartridge 70 into the casing 2, the wheels 71D of the process cartridge 70 roll on the first guide rollers 24A, the first inclined walls 24B, and the first guide rails 24C of the guide portions 24 to move to the rear. At the time when the wheels 71D of the process cartridge 70 ride on the first guide rails 24C, the flanges 71E (FIG. 3(*c*)) of the process cartridge 70 rest on the first guide rollers 24A.

That is, during the movement of the process cartridge 70 to the rear, the wheels 71D of the process cartridge 70 roll on the first guide rails 24C, and the flanges 71E of the process cartridge 70 slide on the rolling first guide rollers 24A. Accordingly, the process cartridge 70 can be moved to the rear with a stable posture. During this movement, the first shutter 100 of the process cartridge 70 confronts the right side surface of the partition wall 137A (FIG. 10) of the casing 2.

Thereafter, the wheels 71D of the process cartridge 70 roll on the second guide rollers 24D, the second inclined walls 24E and the second guide rails 24F and are then stopped at curved rear end portions of the second guide rails 24F. That is, after the movement of the process cartridge 70 in the longitudinal direction to the rear, the process cartridge 70 is moved obliquely rearwards and downwards without being inclined to be positioned in place as shown in FIG. 13. By this series of actions, the process cartridge 70 is attached to the casing 2. When the process cartridge 70 is attached to the casing 2 in this manner, the positioning shafts 71C (FIG. 3(*c*)) is fitted to and positioned by positioning grooves 25 (FIG. 11) formed in the casing 2 (specifically, the walls 137) to position the first housing 71 in place. In this state, as has been described above, the second housings 72 are movable relative to the first housing 71 (see FIGS. 6 and 7).

When the process cartridge 70 is attached to the casing 2, specifically, when the process cartridge 70 is moved obliquely rearwards and downwards without being inclined as has been described above, the projections 126 on each first cover 120 of the first shutter 100 are brought into engagement with the recessed portions 227 (FIG. 10) of the corresponding second cover 220 of the second shutter 200 from above. Concurrently, the recessed portions 127 on each first cover 120 are brought into engagement with the projections 226 (FIG. 10) of the corresponding second cover 220 from above. Accordingly, when the process cartridge 70 is attached to the casing 2, the first shutter 100 in the closed position is brought into engagement with the second shutter 200 in the closed position. In this state, as shown in FIGS. 6 and 7, the first covers 120 of the first shutter 100 are respectively brought into contact with the second covers 220 of the second shutter 200 from the right-hand side.

Thereafter, as is indicated by broken lines in FIG. 13, the second front cover 22 is rotated upwards and thus closed, and as shown in FIG. 14, the top cover 10 is swung downwards and thus closed, so that the intermediate transfer belt 83 of the transfer part 8 is brought into contact with the photosensitive drums 75 of the process cartridge 70.

Here, when the second front cover 22 is closed, the grip 132 of the first shutter 100 in the closed position is inserted into the second insertion hole 22*b* of the second front cover 22 from the rear and is then exposed to the front side of the second front cover 22 (that is, the front surface of the casing 2). Accordingly, the distal end portion 132A of the grip 132 is positioned at a front side of the first insertion hole 22A of the second front cover 22.

Thereafter, when the user grips on the grip 132 and pushes the grip 132 to the rear, the first shutter 100 is moved from the closed position to the open position as shown in FIG. 15. Since the first shutter 100 is in engagement with the second shutter 200, the second shutter 200 is also moved from the closed position to the open position in linking with the first shutter 100.

Accordingly, with reference to FIGS. 6 and 7, the third supply hole 115 of the process cartridge 70 confront and communicates with the fourth supply hole 211 of the partition wall 137A (the second shutter supporting wall 210) of the casing 2 from the right-hand side. Similarly, the third discharge hole 116 of the process cartridge 70 confronts and communicates with the fourth discharge hole 212 of the partition wall 137A (the second shutter supporting wall 210) of the casing 2 from the right-hand side. Since the first supply hole 87 confronts and communicates with the third supply hole 115 and the first discharge hole 88 confronts and communicates with the third discharge hole 116, the first supply hole 87 confronts and communicates with the fourth supply hole 211 and the first discharge hole 88 confronts and communicates with the fourth discharge hole 212. That is, the first opening 80 (one of the first supply hole 87 and the first discharge hole 88) confronts and communicates with the passage opening 213 (corresponding one of the fourth supply hole 211 and the fourth discharge hole 212).

In this state, the first housing 71 having the first opening 80 is positioned in place as has been described above, and the passage opening 213 is formed in the stationary partition wall 137A of the casing 2. Accordingly, the first opening 80 confronts and communicates with the passage opening 213 in a fixed state in which a relative movement between the first opening 80 and the passage opening 213 is inhibited.

Since the passage opening 213 communicates with the interior of the toner box 73 (see FIG. 10), the toner inside the toner box 73 is supplied by passing through via the fourth supply hole 211 (the passage opening 213), the third supply hole 115, the first supply hole 87 and the second supply hole 95 in that order to the left end portion of the first auger 78A as indicated by a broken arrow line in FIG. 6. The toner supplied to the left end portion of the first auger 78A is passed over to the second auger 78B shown in FIG. 7 as has been described above and is then supplied to the supply roller 77 (refer to FIG. 1) by the second auger 78B. The toner that is not supplied to the supply roller 77 is conveyed to the left end portion of the second auger 78B and returned via the second discharge hole 96, the first discharge hole 88, the third discharge hole 116 and the fourth discharge hole 212 (the passage opening 213) in that order to the toner box 73 as indicated by a broken arrow line in FIG. 7. Thus, the toner moves (circulates) between the toner box 73 and the process cartridge 70 via the passage opening 213.

When the first shutter 100 is in the open position, the distal end portion 132A of the grip 132 is inserted from the front into the first insertion hole 22A of the second front cover 22 in the closed state, as is shown in FIG. 15. Since light emitted from the photosensor 23 is blocked by the distal end portion 132 inserted into the first insertion hole 22 and thus cannot be received by the photosensor 23, the photosensor 23 detects a state in which the first shutter 100 is in the open position. Upon detection of the open position of the first shutter 100, a control unit (not shown) for controlling the color printer 1 permits a printing control unless the photosensor detects the open position, the control unit prohibits printing control.

The distal end portion 132A of the grip 132 is inserted from the front side into the first insertion hole 22 of the second front cover 22. That is, the grip 132 in the front side is in engagement with the second front cover 22 of the closed state. Accordingly, unless the first shutter 100 is moved to the closed position to remove the distal end portion 132A of the grip 132 from the first insertion hole 22A as shown in FIG. 14, the engagement between the grip 132 and the second front cover 22 is not released. Therefore, even though the top cover 10 is swung upwards as shown in FIG. 13, the second front cover 22 cannot be opened.

(2) Detachment of Process Cartridge from Body Casing

When the process cartridge 70 is detached from the casing 2, the grip 132 of the first shutter 100 is pulled forwards to move the first shutter 100 from the open position to the closed position as shown in FIGS. 15 and 14. Since the first shutter 100 is in engagement with the second shutter 200 (FIG. 10) in this state, the second shutter 200 is also moved from the open position to the closed position in linking with the first shutter 100. Thereafter, as shown in FIG. 13, the top cover 10 and the second front cover 22 are sequentially opened to provide the opening 2A (FIG. 12) at the front side of the casing 2. Thereafter, as shown in FIG. 12, the process cartridge 70 is pulled out towards the front through the opening 2A and detached from the casing 2.

5. Function and Advantage (1) As shown in FIGS. 6 and 7, this process cartridge 70 is configured such that the second housing 72 supporting the developing roller 76 is attached to the first housing 71 supporting the photosensitive drum 75 to be moveable in the orthogonal direction X relative to the first housing 71. Therefore, the developing roller 76 is movable relative to the photosensitive drum 75 in accordance with the relative movement of the second housing 72 to the first housing 71. That is, the developing roller 76 can appropriately follow (confront) the photosensitive drum 75 in accordance with the surface conditions of the photosensitive drum 75 for smooth supply of the toner to the electrostatic latent image formed on the photosensitive drum 75. Accordingly, a highly accurate visualization of electrostatic latent image is enabled, compared with the case where the developing roller 76 is prevented from being moved relative to the photosensitive drum 75.

As shown in FIGS. 6 and 7, the first opening 80 (the first supply hole 87 and the first discharge hole 88) are formed in the first housing 71, and the second opening 97 (the second supply hole 95 and the second discharge hole 96) are formed in the second housings 72. The first opening 80 (one of the first supply hole 87 and the first discharge hole 88) communicates with the second opening 97 (corresponding one of the second supply hole 95 and the second discharge hole 96). In this communication state, the toner can be supplied from the location outside of the process cartridge 70 via the first opening 80 (the first supply hole 87 shown in FIG. 6) and the second opening 97 (the second supply hole 95 shown in FIG. 6) in that order to the developing roller 76 of the second housing 72. Similarly, the toner in the second housing 72 can be moved (returned) via the second opening 97 (the second discharge hole 96 shown in FIG. 7) and the first opening 80 (the first discharge hole 88 shown in FIG. 7) in that order to the location outside the process cartridge 70.

Since the second housing 72 is movable relative to the first housing 71, the second opening 97 is also movable relative to the first opening 80.

To accommodate the relative movement between the first opening 80 and the second opening 97, the process cartridge 70 is configured to have the elastic element 108. That is, the elastic element 108 can block a gap between the first boss 93 bounding the first opening 80 on the first housing 71 and the second boss 98 bounding the second opening 97 on the second housing 72. Accordingly, even when the second housing 72 is moved relative to the first housing 71, the elastic element 108 is elastically deformed to keep a state in which the elastic element 108 blocks the gap between the first boss 93 and the second boss 98. Consequently, the leakage of the toner between the first opening 80 and the second opening 97 can be prevented, while permitting the relative movement of the second opening 97 to the first opening 80 and maintaining the communication state of the first opening 80 with the second opening 97.

This color printer 1 is configured to have the toner box 73 (FIG. 2) accommodating therein the toner to be supplied to the process cartridge 70 and the passage opening 213 (FIG. 10), through which the toner is moveable between the toner box 73 and the process cartridge 70. The passage opening 213 is formed in at least one of the casing 2 and the toner box 73 (in the partition wall 137A of the casing 2 in this example).

The passage opening 213 (one of the fourth supply hole 211 and the fourth discharge hole 212) communicates with the first opening 80 (corresponding one of the first supply hole 87 and the first discharge hole 88) of the first housing 71 in a state in which a relative positional relationship between the passage opening 213 and the first opening 80 is fixed. Accordingly, the toner can be supplied from the location outside the process cartridge 70 (that is, from the toner box 73) via the passage opening 213 (the fourth supply hole 211 shown in FIG. 6), the first opening 80 (the first supply hole 87 shown in FIG. 6) and the second opening 97 (the second supply hole 95 shown in FIG. 6) in that order to the developing roller 76 in the second housing 72. Similarly, the toner in the second housing 72 can be moved (returned) to the location outside the process cartridge 70 via the second opening 97 (the second discharge hole 96 shown in FIG. 7), the first opening 80 (the first discharge hole 88 shown in FIG. 7) and the passage opening 213 (the fourth discharge hole 212 shown in FIG. 7) in that order. Since the passage opening 213 and the first opening 80 confront each other, the toner can be moved between the passage opening 213 and the first opening 80 smoothly.

In the event that the passage opening 213 confronts directly the second opening 97 without interposing the first opening 80 therebetween, the passage opening 213 has to be arranged movable in accordance with the movement of the second opening 97 following the relative movement of the second housing 72 to the first housing 71. To this end, the toner box 73 side (the partition wall 137A and the toner box 73 in this example) where the passage opening 213 is formed has to be configured to be moveable together with the second housing 72. This means that the toner box 73 and the second housing 72 (that is, the process cartridge 70) are substantially made integrated with each other, and therefore it becomes difficult, or complicated in mechanism, to detach only the process cartridge 70 from the casing 2.

In contrast, according to the printer 1, since the passage opening 213 confronts and communicates with the first opening 80 in advance of the second opening 97 and the relative position between the passage opening 213 and the first opening 80 is fixed, the passage opening 213 does not have to be movable in accordance with the movement of the second opening 97. Accordingly, since the toner box 73 side where the passage opening 213 is formed does not have to be movable together with the second housing 72, the toner box 73 and the process cartridge 70 including the second housing 72 can be separated completely.

Therefore, as shown in FIG. 2, the printer 1 can be arranged to include: the process cartridge 70 having the developing rollers 76 movable relative to the photosensitive drums 75; and the toner box 73, and further, as shown in FIGS. 11 to 15, only the process cartridge 70 can be attached to and detached from the casing 2 separately from the toner boxes 73.

(2) The first shutter 100 is provided on the first housing 71 to open and close the first opening 80 and the second opening 97. The first opening 80 and the second opening 97 are closed by the first shutter 100, and thereafter the process cartridge 70 is attached to and detached from the casing 2. This can prevent the leakage of the toner from the first opening 80 and the second opening 97 during the attachment and detachment of the process cartridge 70 to and from the casing 2.

(3) The second shutter 200 is provided to open and close the passage opening 213 (FIG. 10). The passage opening 213 is closed by the second shutter 200, and thereafter the process cartridge 70 is attached to and detached from the casing 2. This can prevent the leakage of the toner from the passage opening 213 during the attachment and detachment of the process cartridge 70 to and from the casing 7.

(4) The first shutter 100 is provided on the external surface (the left side surface) of the process cartridge 70 (FIG. 9), and the second shutter 200 is provided on the surface of at least one of the casing 2 and the toner box 73, which surface confronts the first shutter (FIG. 10). In this example, the second shutter 200 is provided on the right side surface of the partition wall 137A.

Accordingly, when the first shutter 100 closes the first opening 80 and the second opening 97, the first opening 80 and the second opening 97 are not exposed to the external surface of the process cartridge 70 (FIG. 3(*a*)). This can prevent the dispersion of the toner remaining in the first opening 80 and the second opening 97 to the external surface of the process cartridge 70. Similarly, when the second shutter 200 closes the passage opening 213, the passage opening 213 is not exposed to the surface (the right side surface of the partition wall 137A) which confronts the first shutter 100 (FIG. 10). This can prevent the dispersion of the toner remaining in the passage openings 213 to the right side surface of the partition wall 137A.

The first shutter 100 and the second shutter 200 are arranged to contact with each other. This arrangement makes it possible to locate the passage opening 213 and the first opening 80 close to each other. This can prevent the leakage of the toner between the passage opening 213 and the first opening 80 confronting and communicating with each other.

(5) The opening and closing operation of the first shutter 100 and the opening and closing operation of the second shutter 200 are linked with each other. When one of the first shutter 100 and the second shutter 200 is operated to open or close, the other of the first shutter 100 and the second shutter 200 is concurrently opened and closed. Accordingly, the operability can be improved.

(6) The first boss 93 bounds the first opening 80 on the first housing 71, and the second boss 98 bounds the second opening 97 on the second housing 72. The first portion 93A is provided on the first boss 93 to overlap the second boss 98 in the width direction, and the second portion 98A is provided on the second boss 98 to overlap the first portion 93A in the width direction.

Here, one of the first portion and the second portion is disposed in the inside of the other and the elastic element is held by and between the first portion and the second portion. This can surely position the elastic element in place, and surely prevent toner leakage between the first portion 93A and the second portion 98A.

(7) The direction in which the first portion 93A and the second portion 98A hold the elastic element 108 therebetween coincides with the orthogonal direction X, that is, the direction in which the second housing 72 is movable relative to the first housing 71. Accordingly, even when the second housing 72 is moved relative to the first housing 71, the first portion 93A and the second portion 98A surely maintain the elastic element 108 held therebetween. That is, it is possible to prevent the elastic element 108 from being dislocated from the first portion 93A and the second portion 98A.

(8) The first portion 93A project from the left-hand side wall 71A of the first housing 71 having the first opening 80, and the second portion 98A project from the left-hand side wall 72C of the second housing 72 having the second opening 97. One of the first portion 93A and the second portion 98A is disposed in the inside of the other, and the elastic element 108 is held by and between the first portion 93A and the second portion 98A. This arrangement can ensure larger areas, of the first portion 93A and the second portion 98A, for holding the elastic element 108. Accordingly, an ensured positioning of the elastic element 108 can be realized. Further, larger the areas for holding the elastic element 108, longer the passage to a location where the toner leaks from the elastic element 108. Therefore, this arrangement also contributes to surely preventing the leakage of the toner.

(9) The second portion 98A on the second housing 72 projects towards the left-hand side wall 71A of the first housing 71. That is, the second portion 98A projects in a direction away from the second housing 72. Compared with a case where the second portion 98A projects in a direction approaching the second housing 72 (in a direction in which the second projection is recessed into the interior of the second housing 72), a large space can be ensured within the second housings.

(10) The elastic element 108 includes the first elastic element 94 adhered to the first portion 93A and the second elastic element 105 adhered to the second portion 98A to be closely contacted with the first elastic element 94. Namely, the elastic element 108 is divided into the first elastic element 94 and the second elastic element 105.

In the case of the elastic element 108 being an integral piece that cannot be divided, it becomes difficult for the elastic element 108 to adhere to both the first portion 93A and the second portion 98A. When the elastic member 108 is adhered to only one of the first portion 93A and the second portion 98A, there is caused a fear that a toner leakage will be caused between the other to which the elastic element 108 is not adhered and the elastic element 108. In particular, since the second housing 72 is movable in the orthogonal direction X (FIGS. 6 and 7) relative to the first housing 71, the second housing 72 vibrates in the relative movement direction (the orthogonal direction X) in conjunction with the rotation of the photosensitive drum 75 during the image formation, and the vibration of the second housing 72 may promote the penetration of the toner into the gap between the first portion 93A and the second portion 98A.

In contrast, according to the printer 1, the elastic element 108 is divided into the first elastic element 94 and the second elastic element 105, and the first elastic element 94 is adhered to the first portion 93A while the second elastic element 105 is adhered to the second portion 98A. Accordingly, the elastic element 108 can be easily adhered to both the first portion 93A and the second portion 98A. By this configuration, the toner leakage can be prevented between the elastic element 108 and each of the first portion 93A and the second portion 98A. Further, the first elastic element 94 and the second elastic element 105 are in close contact with each other. Therefore, even when the second housing 72 vibrates, there is no fear that the toner leaks from between the first elastic element 94 and the second elastic element 105. Compared with a case where at least one of the first elastic element 94 and the second elastic element 105 is made of a resin or metal, the first elastic element 94 and the second elastic element 105, both made from the porous materials, can be more closely contacted with each other by compression and deformation of both the porous materials. Therefore, the risk that the toner leaks between the first elastic element 94 and the second elastic element 105 can be significantly reduced. The toner leakage attributed to the vibration of the second housing 72 propagates in a direction parallel to the vibrating direction of the second housing 72 (the direction in which the second housing 72 is movable relative to the first housing 71, that is, the orthogonal direction X). In the embodiment, the close contact surface (the joint) between the first elastic element 94 and the second elastic element 105 is coincide with the direction which intersects the aforesaid vibrating direction (the orthogonal direction X) (desirably at right angles), and therefore the toner is prevented from reaching the first housing 71 and a location outside the second housing 72 via the joint unless the toner leaks in that direction. Therefore, the leakage of the toner is made more difficult to occur.

(11) The conveying auger 78 (the first auger 78A and the second auger 78B) for conveying the toner is supported in the second housing 72. The left end portion of the conveying auger 78 is disposed in the inside of the second portion 98A which is disposed in the inside of the first portion 93A. Accordingly, even though the second housing 72 is moved relative to the first housing 71, the left end portion of the auger 78, which is moved together with the second housing 72, can be prevented from colliding against the first portion 93A.

6. Modified Examples

Figures 16A, 16B, 16C, 16D, 16E, 16F, 16G:
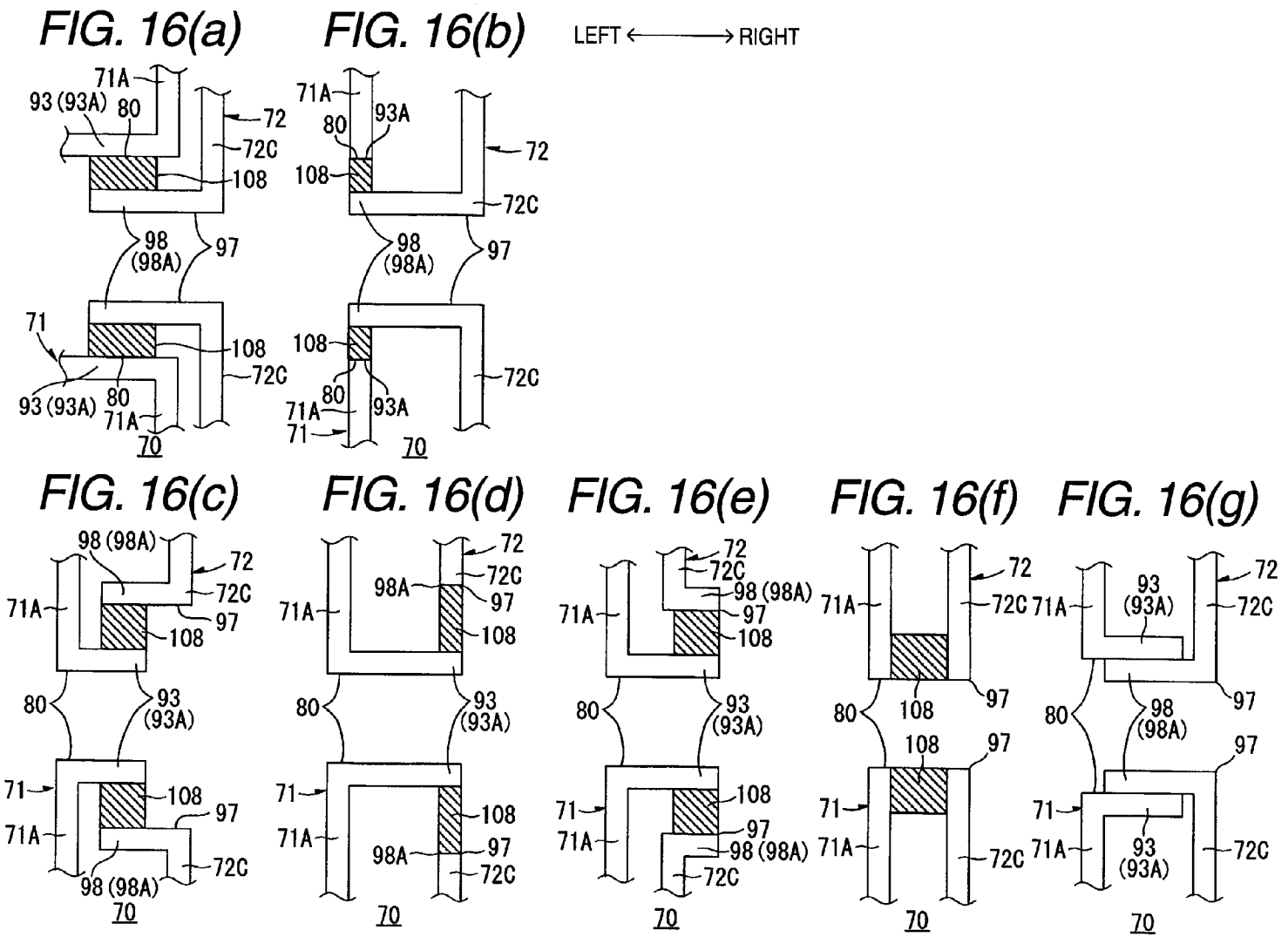
FIGS. 16(*a*) to 16(*g*) are schematically sectional views of main parts of left-hand side walls of first housings and left-hand side walls of second housings according to modified examples.

FIGS. 16(*a*) to 16(*g*) are diagrams schematically showing sectional views of main parts of left-hand side walls of first housings and left-hand side walls of second housings according to modified examples.

In the embodiment that has been described heretofore, as shown in FIGS. 6 and 7, the process cartridge 70 is configured such that the second boss 98 projecting leftwards from the left-hand side wall 72C of the second housing 72 is disposed in the inside of the first boss 93 projecting rightwards from the left-hand side wall 71A of the first housing 71. Further, the elastic element 108 (specifically the first elastic element 94 and the second elastic element 105) is held by and between the first portion 93A of the first boss 93 and the second portion 98A of the second boss 98.

This arrangement can be modified as shown in FIGS. 16(*a*) to 16(*g*).

In FIG. 16(*a*), a first boss 93 projects leftwards from a left-hand side wall 71A, and a second boss 98 projects leftwards from a left-hand side wall 72C of a second housing 72. The second boss 98 is disposed in an inside of the first boss 93. An elastic element 108 is held by and between a first portion 93A of the first boss 93 and a second portion 98A of the second boss 98.

In FIG. 16(*b*), no first boss 93 is provided, and a second boss 98 projects leftwards from a left-hand side wall 72C of a second housing 72. The second boss 98 is disposed in an inside of a first opening 80 in a left-hand side wall 71A. An elastic element 108 is held by a first portion 93A (a portion which bounds the first opening 80 on the left-hand side wall 71A) and a second portion 98A of the second portion 98. In this case, although the portions on the first portion 93A and the second portion 98A which hold the elastic element 108 becomes smaller than that in the configuration shown in FIG. 16(*a*), a first housing 71 can be made smaller in size.

In FIG. 16(*c*), a first boss 93 projects rightwards from a left-hand side wall 71A and is disposed in an inside of a second boss 98 projecting leftwards from a left-hand side wall 72C of a second housing 72. An elastic element 108 is held by and between a first portion 93A of the first boss 93 and a second portion 98A of the second boss 98.

In FIG. 16(*d*), no second boss 98 is provided, and a first boss 93 is disposed in an inside of a second opening 97 in a left-hand side wall 72C of a second housing 72. An elastic element 108 is held by and between a second portion 98A (a portion which bounds the second opening 97 on the left-hand side wall 72C) and a first portion 93A of the first boss 93.

In FIG. 16(*e*), a first boss 93 projects rightwards from a left-hand side wall 71A, and the first boss 93 is disposed in an inside of a second boss 98. The second boss 98 projects rightwards from a left-hand side wall 72C of a second housing 72. An elastic element 108 is held by and between a first portion 93A of the first boss 93 and a second portion 98A of the second boss 98.

In the configurations shown in FIGS. 16(*c*) to 16(*e*), the left end portion of the conveying auger 78 (refer to FIGS. 6 and 7) is disposed in an inside of the first boss 93 disposed in the inside of the second boss 98.

In FIG. 16(*f*), no boss 93 is provided on a left-hand side wall 71A of a first housing 71, and no second boss 98 is provided on a left-hand side wall 72C of a second housing 72. In this case, an elastic element 108 has a tubular shape and is formed by a rubber tube, for example. The elastic element 108 blocks a gap between a portion bounding a first opening 80 of a right side surface of the left-hand side wall 71A and a portion bounding a second opening 97 of a left side surface of the left-hand side wall 72C, while surrounding those bounding portions.

In FIG. 16(*g*), a modification is shown, in which a first boss 93 (specifically a first portion 93A) of a first housing 71 also functions as an elastic element 108. In this case, the first boss 93 is made, for example, of a rubber tube. A second boss 98 of a second housing 72 is disposed in an inside of the first boss 93. Since the first portion 93A also functions as the elastic element 108, a reduction in the number of components involved can be realized. In a case where the second boss 98 is disposed in the inside of the first boss 93, the left end portion of the conveying auger 78 (FIGS. 6 and 7) is disposed in an inside of the second boss 98. Therefore, if the second boss 98 is configured to also function as the elastic element 108, the second boss 98 is easily deformed, and therefore the second boss 98 cannot protect the conveying auger 78 disposed therein. For this reason, the first boss 93 desirably functions as the elastic element 108 rather than the second boss 98.

Referring to FIGS. 9 and 10, there may be a case where the partition wall 137A of the casing 2 does not exist between the toner box 73 and the process cartridge 70. In this case, the passage opening 213 which are formed in the partition wall 137A in FIG. 10 is formed in a surface of the toner box 73 which surface confronts the first shutter 100. Further, the second shutter 200 for opening and closing the passage openings 213 is provided on the surface of the toner box 73 to confront the first shutter 100.

A configuration may, of course, be adopted in which the partition wall 137A having the second shutter 200 kept existing, and an additional shutter is provided for opening and closing an opening which is formed in a surface of the toner box 73 and which confronts and communicates with the passage opening 213 of the partition wall 137A.

In addition, while in the embodiment, the color printer is described as the example of the image forming apparatus, the invention is not limited thereto and hence may be applied to other image forming apparatuses including, for example, a copier, multifunction device and the like.

As discussed above, the present invention can provide at least the following illustrative, non-limiting embodiments:

(1) An image forming apparatus including a casing, a process cartridge detachably installed in the casing, and a toner box, installed in the casing, for accommodating toner to be supplied, wherein: a passage opening, through which the toner is movable between the toner box and the process cartridge is formed in at least one of the casing and the toner box; the process cartridge includes a first housing which rotatably supports an electrostatic latent image carrying carrier adapted to carry an electrostatic latent image and which has a first opening for the toner to pass therethrough, and a second housing which supports a toner carrier adapted to carry the toner, which is attached to the first housing so that the toner carrier confronts the electrostatic latent image carrier and the second housing is movable relative to the first housing in an orthogonal direction substantially orthogonal to a rotational axis of the electrostatic latent image carrier and which has a second opening for the toner to pass therethrough; the first opening and the passage opening confront and communicate with each other in such a state that relative position of the first opening to the passage opening is fixed; and the process cartridge further includes an elastic element which blocks a gap between a first edge portion bounding the first opening on the first housing and a second edge portion, bounding the second opening on the second housings, such that the elastic element permits relative movement between the first opening and the second opening while maintaining communication between the first opening and the second opening.

(2) An image forming apparatus of (1), wherein a first shutter for opening and closing the first opening and the second opening is provided on the first housing.

(3) An image forming apparatus of (2), wherein a second shutter is provided for opening and closing the passage opening.

(4) An image forming apparatus of(3), wherein the first shutter is provided on an external surface of the process cartridge, the second shutter is provided on a surface of at least one of the casing and the toner box, which surface confronts the first shutter, and the first shutter and the second shutter are in contact with each other.

(5) An image forming apparatus of (3) or (4), wherein opening and closing of the first shutter and opening and closing operations of the second shutter are linked with each other.

(6) An image forming apparatus of any one of (1) to (5), wherein a first portion is provided on the first edge portion to overlap the second edge portion in a direction of the rotational axis, a second portion is provided on the second edge portion to overlap the first portion in the rotational axis direction, one of the first portion and the second portion is disposed inside of the other, and the elastic element is held by and between the first portion and the second portion.

(7) An image forming apparatus of (6), wherein a direction in which the first portion and the second portion hold the elastic element therebetween coincides with the orthogonal direction.

(8) An image forming apparatus of (7), wherein the first housing includes a first wall in which the first opening is formed, the second housing includes a second wall in which the second opening is formed, the first portion projects from the first wall, and the second portion projects from the second wall.

(9) An image forming apparatus of (8), wherein the first portion projects toward the second wall, and the second portion projects toward the first wall.

(10) An image forming apparatus of (9), wherein the elastic element includes a first elastic element made from a porous material adhered to the first portion and a second elastic element made from a porous material adhered to the second portion and the first elastic element and the second elastic element are closely contacted with each other.

(11) An image forming apparatus of (9) or (10), wherein a toner conveying member for conveying the toner is supported in the second housing, and an axial end portion of the toner conveying member is disposed inside the one of the first portion and the second portion.

(12) An image forming apparatus of (11), wherein the second portion is disposed inside the first portion, and the axial end portion of the toner conveying member is disposed inside the second portion.

(13) An image forming apparatus of (12), wherein the first portion also functions as the elastic element.

(14) A process cartridge including: a first housing which rotatably supports an electrostatic latent image carrier adapted to carry an electrostatic latent image and which has a first opening for toner to pas therethrough; a second housing which supports a toner carrier adapted to carry the toner, which is attached to the first housing so that the toner carrier confronts the electrostatic latent image carrier and the second housing is movable relative to the first housing in an orthogonal direction substantially orthogonal to a rotational axis of the electrostatic latent image carrier and which has a second opening for the toner to pass therethrough; and an elastic element which blocks a gap between a first edge portion bounding the first opening on the first housing and a second edge portion bounding the second opening on the second housing such that the elastic element permits relative movement between the first opening and the second opening, while maintaining communicate between the first opening and the second opening, the process cartridge being detachably installable in a casing of an image forming apparatus.

(15) A process cartridge of (14), wherein a first shutter for opening and closing the first opening and the second opening is provided on the first housing.

(16) A process cartridge of (14) or (15), wherein a first portion is provided on the first edge portion to overlap the second edge portion in the rotational axis direction, a second portion is provided on the second edge portion to overlap the first portion in the rotational axis direction, one of the first portion and the second portion is disposed inside the other, and the elastic element is held by and between the first portion and the second portion.

(17) A process cartridge of (16), wherein a direction in which the first portion and the second portion hold the elastic element therebetween coincides with the orthogonal direction.

(18) A process cartridge of (17), wherein the first housing includes a first wall in which the first opening is formed, the second housing includes a second wall in which the second opening is formed, the first portion projects from the first wall, and the second portion projects from the second wall.

(19) A process cartridge of (18), wherein the first portion projects toward the second wall, and the second portion projects toward the first wall.

(20) A process cartridge of (19), wherein the elastic element includes a first elastic element made from a porous material adhered to the first portion and a second elastic element made from a porous material adhered to the second portion and the first elastic element and the second elastic element are closely contacted with each other.

(21) A process cartridge of (19) or (20), wherein a toner conveying member for conveying the toner is supported in the second housing, and an axial end portion of the toner conveying member is disposed inside the one of the first portion and the second portion.

(22) A process cartridge of (21), wherein the second portion is disposed inside the first portion, and the axial end portion of the toner conveying member is disposed inside the second portion.

(23) A process cartridge of (22), wherein the first portion also functions as the elastic element.

According to (1), the second housing supporting the toner carrying carrier is attached to the first housing supporting the electrostatic latent image carrier to be movable relative to the first housing in the orthogonal direction substantially orthogonal to the rotational axis direction of the electrostatic latent image carrier. Accordingly, the toner carrier can be moved relative to the electrostatic latent image carrier in accordance with the relative movement of the second housing to the first housing to appropriately follow (confront) the electrostatic latent image carrier in accordance with the surface condition of the electrostatic latent image carrier. The toner can be supplied to the electrostatic latent image on the electrostatic latent image carrier smoothly, and therefore a highly accurate visualization of the electrostatic latent image is achieved, compared with a case where the toner carrier cannot be moved relative to the electrostatic latent image carrier.

The first opening is formed in the first housing, and the second opening is formed in the second housing. When the first opening and the second opening communicate with each other, the toner can be supplied to the toner carrier in the second housing via the first opening and the second opening from the location outside the process cartridge, and the toner can be moved to the location outside the process cartridge via the second opening and the first opening.

Since the second housing is movable relative to the first housing, the second opening is also movable relative to the first opening.

To accommodate the relative movement between the first opening and the second opening, the process cartridge has the elastic element which blocks the gap between the first edge portion bounding the first opening on the first housing and the second edge portion bounding the second opening on the second housings. When the second housing is moved relative to the first housing, the elastic element is elastically deformed to maintain the state of blocking the gap between the first edge portion and the second edge portions. Accordingly, the leakage of the toner between the first opening and the second opening can be prevented while permitting the relative movement of the second opening to the first opening and maintaining communication between the first opening and the second opening.

This image forming apparatus is arranged so that the toner to be supplied to the process cartridge is accommodated in the toner box, and the passage opening, through which the toner is movable between the toner box and the process cartridge is formed in at least one of the casing and the toner box.

Here, the passage opening and the first opening of the first housing confront and communicate with in such a state that the relative position of the passage opening and the first opening is fixed. The toner can pass through the passage opening, the first opening and the second opening in that order to be supplied to the toner carrier in the second housings. Similarly, the toner in the second housings can pass through the second opening, the first opening and the passage opening in that order to be moved to the location outside the process cartridge. Since the passage opening and the first opening confront each other, the toner can be moved between the passage opening and the first opening smoothly.

Since the passage opening confronts and communicates with the first opening in advance of the second opening and the relative position between the passage opening and the first opening is fixed, the passage opening do not have to be moved even when the second opening is moved. Accordingly, since the toner box side where the passage opening is formed does not have to be moved together with the second housing, the toner box and the process cartridge including the second housing can be separated completely. Only the process cartridge can be detachably installed in the casing separately from the toner box.

According to the (2) and (15), since the first shutter provided on the first housing opens and closes the first opening and the second opening, the first opening and the second opening are closed by the first shutter and thereafter the process cartridge is attached to and detached from the casing, thereby preventing the leakage of the toner from the first opening and the second opening during the attachment and detachment of the process cartridge to and from the casing.

According to (3), since the second shutter opens and closes the passage opening, the passage opening is closed by the second shutter and thereafter the process cartridge is attached to and detached from the casing, thereby preventing the leakage of toner from the passage opening during the attachment and detachment of the process cartridge to and from the casing.

According to (4), the first shutter is provided on the external surface of the process cartridge and the second shutter is provided on the surface of at least one of the casing and the toner box, which surface confronts the first shutter.

When the first shutter closes the first opening and the second opening, the first opening and the second opening are not exposed to the external surface of the process cartridge, and therefore the dispersion of the toner remaining in the first opening and the second opening to the external surface of the process cartridge can be prevented. Similarly, when the second shutter closes the passage opening, the passage opening is not exposed to the surface confronting the first shutter, and therefore the dispersion of the toner remaining in the passage opening to the surface confronting the first shutter can be prevented.

The first shutter and the second shutter can be contacted with each other to locate the passage opening and the first opening close to each other. This arrangement also contributes to preventing the leakage of the toner between the passage opening and the first opening.

According to (5), since the opening and closing of the first shutter and the opening and closing of the second shutter are linked with each other, opening and closing of one of the first shutter and the second shutter causes opening and closing of the other. Therefore, the operability can be improved.

According to (6) and (16), the first portion is provided on the first edge portion to overlap the second edge portion in the rotational axis direction of the electrostatic latent image carrier, and the second portion is provided on the second edge portion to overlap the first portion in the same rotational direction.

Since one of the first portion and the second portion is disposed inside the other and the elastic element is held by and between the first portion and the second portion, the elastic element can be surely positioned in place, thereby making it possible to ensure the prevention of toner leakage.

According to (7) and (17), the direction in which the first portion and the second portion hold the elastic element therebetween coincides with the orthogonal direction substantially orthogonal to the rotational axis direction of the electrostatic latent image carrier, that is, the direction in which the second housing is moveable relative to the first housing. Even when the second housing is moved relative to the first housing, the state in which the elastic element is held by the first portion and the second portion therebetween is surely maintained, and therefore the dislocation of the elastic element from between the first portion and the second portion can be prevented.

According to (8) and (18), the first portion projects from the first wall of the first housing in which the first opening is formed, and the second portion projects from the second wall of the second housing in which the second opening is formed. One of the first portion and the second portion is disposed inside the other and the elastic element is held by and between the first portion and the second portion. This arrangement can enlarge portions of the first portion and the second portion where the elastic element is held. By this arrangement, since a long passage to a location where the toner leaks from the elastic element to the outside can be ensured, the leakage of the toner can be surely prevented.

According to (9) and (19), the second portion on the second housing projects toward the first wall of the first housing. Namely, the second portion projects in a direction away from the second housing. Compared with a case where the second portion projects in a direction in which the second portion is recessed into the interior of the second housing, a large space can be ensured within the second housing.

According to (10) and (20), the elastic element includes the first elastic element adhered to the first portion and the second elastic element adhered to the second portion and the first elastic element and the second elastic element are closely contacted with each other.

Since the elastic element is divided into the first elastic element and the second elastic element, the first elastic element can be adhered to the first portion while the second elastic element can be adhered to the second portion. That is, the elastic element can be adhered to both the first portion and the second portion. Consequently, the toner leakage can be prevented between each of the first portion and the second portion and the elastic element. Further, since the first elastic element and the second elastic element, both of which are made from the porous materials, are in close contact with each other, the porous materials are compressed and deformed. Consequently, the first and second elastic elements can be more closely contacted with each other, thereby significantly reducing the risk of the toner leakage between the first elastic element and the second elastic element. Furthermore, since the joint between the first elastic element and the second elastic element is orthogonal to the orthogonal direction in which the second housing is movable relative to the first housing, the penetration of the toner into the joint can be surely prevented.

According to (11) and (21), the toner conveying member for conveying the toner is supported in the second housing. One of the first portion and the second portion is disposed inside the other, and the end portion of the toner conveying member is disposed inside the one of the first and second portions. Since the toner in the one of the first and second portions is conveyed to the toner conveying member, the toner can be prevented from remaining inside the one of the first and second portions.

According to (12) and (22), the second portion of the second housing is disposed inside the first portion of the first housing, and the end portion of the toner conveying member is disposed inside of the second portion. Even though the second housing is moved relative to the first housing, the end portion of the toner conveying member moved together with the second housing can be prevented from colliding with the first portion.

According to (13) and (23), since the first portion also functions as the elastic element, a reduction in the number of components involved can be realized.

According to (14), the second housing supporting the toner carrier is attached to the first housing supporting the electrostatic latent image carrier in such a manner as to be movable relative to the first housing in the orthogonal direction substantially to the rotational axis of the electrostatic latent image carrier. Accordingly, the toner carrier can be moved relative to the electrostatic image carrier in accordance with the relative movement of the second housing to the first housing to appropriately follow (confront) the electrostatic latent image carrier in accordance with the surface condition of the electrostatic latent image carrier. Accordingly, the toner can be supplied to the electrostatic latent image on the electrostatic latent image carrier smoothly. Compared with a case where the toner carrier is not movable relative to the electrostatic latent image carrier, a highly accurate visualization of the electrostatic latent image can be enabled.

The first opening is formed in the first housing, and the second opening is formed in the second housing. The first opening and the second opening communicate with each other. The toner can pass through the first opening and the second opening in that order to be supplied to the toner carrier in the second housing from the location outside the process cartridge. Similarly, the toner can pass through the second opening and the first opening in that order to be discharged to the location outside the process cartridge.

Since the second housing is movable relative to the first housing, the second opening is also movable relative to the first opening.

To accommodate the relative movement between the first opening and the second opening, the process cartridge includes the elastic element which blocks the gap between the first edge portion bounding the first opening on the first housing and the second edge portion bounding the second opening on the second housing. When the second housing is moved relative to the first housing, the elastic element is deformed elastically to maintain the state of blocking the gap between the first edge portion and the second edge portion and communication between the first opening and the second opening. Accordingly, the leakage of the toner between the first opening and the second opening can be prevented while permitting the relative movement of the second opening to the first opening.

What is claimed is:

1. An image forming apparatus comprising:

a casing, a process cartridge configured to be detachably attached to the casing, and a toner box configured to be attached to the casing, wherein at least one of the casing and the toner box has a passage opening through which toner is movable between the toner box and the process cartridge, the process cartridge comprises:

a first housing which rotatably supports an image carrier and which has a first opening and a first edge portion bounding the first opening; and a second housing which supports a toner carrier, which is attached to the first housing so that the toner carrier confronts the image carrier and the second housing is movable relative to the first housing in an orthogonal direction substantially orthogonal to a rotational axis of the image carrier and which has a second opening and a second edge portion bounding the second opening, the process cartridge is configured to be attached to the casing so that the first opening confronts and communicates with the passage opening and a relative position of the first opening to the passage opening is fixed, and the process cartridge further comprises an elastic element which blocks a gap between the first edge portion and the second edge portion and which permits relative movement between the first opening and the second opening, while allowing toner communication between the first opening and the second opening.

2. An image forming apparatus as set forth in claim 1, wherein the process cartridge further comprises a shutter, disposed on the first housing, for opening and closing the first opening and the second opening.

3. An image forming apparatus as set forth in claim 2, further comprising a second shutter for opening and closing the passage opening, wherein the shutter is a first shutter.

4. An image forming apparatus as set forth in claim 3, wherein the first shutter is disposed on an external surface of the process cartridge, the second shutter is disposed on a surface of at least one of the casing and the toner box, the surface confronting the first shutter when the process cartridge is attached to the casing, and the first shutter and the second shutter are in contact with each other.

5. An image forming apparatus as set forth in claim 3, further comprising a link which links opening and closing of the first shutter with opening and closing of the second shutter.

6. An image forming apparatus as set forth in claim 1, wherein the first edge portion has a first portion which overlaps the second edge portion as viewed in the orthogonal direction, the second edge portion has a second portion which overlaps the first portion as viewed in the orthogonal direction, one of the first portion and the second portion is disposed inside the other of the first portion and the second portion, and the elastic element is held between the first portion and the second portion in the orthogonal direction.

7. An image forming apparatus as set forth in claim 6, wherein the first housing comprises a first wall having the first opening the second housing comprises a second wall having the second opening, the first portion projects from the first wall, and the second portion projects from the second wall.

8. An image forming apparatus as set forth in claim 7, wherein the first portion projects toward the second wall, and the second portion projects toward the first wall.

9. An image forming apparatus as set forth in claim 8, wherein the elastic element includes a porous first elastic element and a porous second elastic element, the first elastic element is adhered to the first portion and the second elastic element is adhered to the second portion, and the first elastic element makes close contact with the second elastic element.

10. An image forming apparatus as set forth in claim 8, wherein the second housing supports a toner conveying member, and an axial end portion of the toner conveying member is disposed inside the one of the first portion and the second portion.

11. An image forming apparatus as set forth in claim 10, wherein the second portion is disposed inside the first portion, and the axial end portion of the toner conveying member is disposed inside the second portion.

12. An image forming apparatus as set forth in claim 11, wherein at least a part of the first portion functions as the elastic element.

13. A process cartridge configured to be detachably attachable to an image forming apparatus, the process cartridge comprising:

a first housing which rotatably supports an image carrier and which has a first opening and a first edge portion bounding the first opening;

a second housing which supports a toner carrier, which is attached to the first housing so that the toner carrier confronts the image carrier and the second housing is movable relative to the first housing in an orthogonal direction substantially orthogonal to a rotational axis of the image carrier and which has a second opening and a second edge portion bounding the second opening; and an elastic element which blocks a gap between the first edge portion and the second edge portion and which permits relative movement between the first opening and the second opening, while allowing toner communication between the first opening and the second opening.

14. A process cartridge as set forth in claim 13, further comprising:

a shutter, disposed on the first housing, for opening and closing the first opening and the second opening.

15. A process cartridge as set forth in claim 13, wherein the first edge portion has a first portion which overlaps the second edge portion as viewed in the orthogonal direction the second edge portion has a second portion which overlaps the first portion as viewed in the orthogonal direction, one of the first portion and the second portion is disposed inside the other of the first portion and the second portion, and the elastic element is held between the first portion and the second portion in the orthogonal direction.

16. A process cartridge as set forth in claim 15, wherein the first housing comprises a first wall having the first opening, the second housing comprises a second wall having the second opening, the first portion projects from the first wall, and the second portion projects from the second wall.

17. A process cartridge as set forth in claim 16, wherein the first portion projects toward the second wall, and the second portion projects toward the first wall.

18. A process cartridge as set forth in claim 17, wherein the elastic element includes a porous first elastic element and a porous second elastic element, the first elastic element is adhered to the first portion and the second elastic element is adhered to the second portion, and the first elastic element makes close contact with the second elastic element.

19. A process cartridge as set forth in claim 17, wherein the second housing supports a toner conveying member, and an axial end portion of the toner conveying member is disposed inside the one of the first portion and the second portion.

20. A process cartridge as set forth in claim 19, wherein the second portion is disposed inside the first portion, and the axial end portion of the toner conveying member is disposed inside the second portion.

21. A process cartridge as set forth in claim 20, wherein at least a part of the first portion functions as the elastic element.

* * * * *